US007883616B2

(12) United States Patent
Shoji et al.

(10) Patent No.: US 7,883,616 B2
(45) Date of Patent: Feb. 8, 2011

(54) METAL OXIDE AND/OR METAL HYDROXIDE COATED METAL MATERIALS AND METHOD FOR THEIR PRODUCTION

(75) Inventors: Hiromasa Shoji, Futtsu (JP); Tsutomu Sugiura, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/497,616

(22) PCT Filed: Dec. 3, 2002

(86) PCT No.: PCT/JP02/12682

§ 371 (c)(1),
(2), (4) Date: Jun. 2, 2004

(87) PCT Pub. No.: WO03/048416

PCT Pub. Date: Jun. 12, 2003

(65) Prior Publication Data

US 2005/0067056 A1 Mar. 31, 2005

(30) Foreign Application Priority Data

Dec. 4, 2001 (JP) ..... 2001-370382
Dec. 4, 2001 (JP) ..... 2001-370498

(51) Int. Cl.
*C23C 22/34* (2006.01)

(52) U.S. Cl. ..... 205/316; 205/333; 205/320; 205/323

(58) Field of Classification Search ..... 438/628; 205/333
See application file for complete search history.

(56) References Cited

U.S. PATENT DOCUMENTS 2,738,294 A * 3/1956 Spence ..... 134/42
3,337,431 A 8/1967 Kitamura et al.
3,519,542 A 7/1970 Kitamura et al.

(Continued)

FOREIGN PATENT DOCUMENTS

DE 19754108 A1 6/1999

(Continued)

OTHER PUBLICATIONS

Zairyou [Materials] by Nitta, S. et al., vol. 43, No. 494, pp. 1437-1443, Nov. 1994.

(Continued)

*Primary Examiner*—Jennifer C McNeil
*Assistant Examiner*—Jason L Savage
(74) *Attorney, Agent, or Firm*—Kenyon & Kenyon LLP

(57) ABSTRACT

A method for production of a metal oxide and/or metal hydroxide coated metal material comprises immersing a metal material or electrolyzing a conductive material in an aqueous treatment solution at pH 2-7 containing metal ion and fluorine ion in a 4-fold or more molar ratio with respect to the metal ion, and/or containing a complex ion comprising at least a metal and fluorine in a 4-fold or more molar ratio with respect to the metal, to form on the surface of the metal material a metal oxide and/or metal hydroxide coating containing the metal ion and/or the metal, as well as a metal oxide and/or metal hydroxide coated metal material having a metal oxide and/or metal hydroxide coating produced by the method.

21 Claims, 4 Drawing Sheets

U.S. PATENT DOCUMENTS

| | | | | |
|---|---|---|---|---|
| 3,531,384 | A | 9/1970 | Inouye et al. | |
| 3,539,403 | A | 11/1970 | Ries | |
| 4,470,853 | A | 9/1984 | Das et al. | |
| 5,143,562 | A | 9/1992 | Boulos | |
| 5,342,456 | A * | 8/1994 | Dolan | 148/247 |
| 5,380,374 | A | 1/1995 | Tomlinson | |
| 5,584,946 | A | 12/1996 | Karmaschek et al. | |
| 5,964,928 | A | 10/1999 | Tomlinson | |
| 6,312,812 | B1 | 11/2001 | Hauser et al. | |
| 2003/0070935 | A1 * | 4/2003 | Dolan | 205/321 |
| 2003/0075453 | A1 * | 4/2003 | Dolan | 205/324 |
| 2004/0244874 | A1 | 12/2004 | Nakayama et al. | |

FOREIGN PATENT DOCUMENTS

| | | | |
|---|---|---|---|
| DE | 199 33 189 | A | 1/2001 |
| EP | 0 777 058 | A1 | 6/1997 |
| FR | 1 450 726 | | 6/1966 |
| FR | 1 454 202 | | 7/1966 |
| GB | 129 969 | | 10/1919 |
| GB | 1 373 150 | | 11/1974 |
| JP | 59-83775 | A | 5/1984 |
| JP | A-64-8296 | | 1/1989 |
| JP | 5-163584 | | 6/1993 |
| JP | 7-216556 | A | 8/1995 |
| JP | 9-209189 | | 8/1997 |
| JP | 10-018083 | | 1/1998 |
| JP | 2828359 | | 9/1998 |
| JP | 11-158691 | | 6/1999 |
| JP | 2000-64090 | | 2/2000 |
| JP | 2000-282256 | | 10/2000 |
| JP | 2001-131792 | | 5/2001 |
| WO | WO-85/05131 | A1 * | 11/1985 |
| WO | WO 85/05131 | A1 | 11/1985 |
| WO | WO 91/13186 | A1 | 9/1991 |
| WO | WO 93/12268 | | 6/1993 |
| WO | WO 01/71067 | | 9/2001 |
| WO | WO 02/103080 | | 12/2002 |

OTHER PUBLICATIONS

Japanese Office Action dated Jun. 24, 2008 issued in corresponding Japanese Application No. 2003-549591.

* cited by examiner

METAL OXIDE AND/OR METAL HYDROXIDE COATED METAL MATERIALS AND METHOD FOR THEIR PRODUCTION

TECHNICAL FIELD

The present invention relates to metal oxide and/or metal hydroxide coated metal materials and to a method for their production.

BACKGROUND ART

Vapor phase methods such as sputtering or CVD and liquid phase methods such as sol-gel methods have been used as methods for producing various types of oxide films, but they have been limited in the following ways.

Vapor phase methods accomplish film formation on substrates in the vapor phase and therefore require costly equipment in order to achieve a vacuum system. Means are also necessary for heating the substrate prior to film formation. It is also difficult to form films on substrates with irregularities or curved surfaces.

Sol-gel methods, as liquid phase methods, require firing after application and therefore result in generation of cracks and dispersion of metal from the substrate. Because of the volatile portion, it is difficult to form a dense coating.

One liquid phase method wherein an aqueous fluorine compound solution such as fluoro-complex ion is used, known as liquid phase deposition, does not require costly equipment to achieve a vacuum, and allows film formation without heating the substrate to high temperature while also allowing formation of thin films on irregularly-shaped substrates. However, because the solutions are corrosive, this method is mainly employed for substrates of non-metal materials, such as glass, polymer materials and ceramics.

In contrast, Japanese Unexamined Patent Publication SHO No. 64-8296 proposes forming a silicon dioxide film on a substrate of a metal, alloy, semiconductor substrate or the like which is at least partially conductive on the surface. As regards the effect on the substrate, however, the text merely states that "it is also possible to add boric acid or aluminum to the treatment solution in order to prevent etching", and this alone is insufficient. Also, an article by Nitta, S. et al. in Zairyo [Materials], Vol.43, No.494, pp.1437-1443(1994) describes contacting aluminum with a stainless steel substrate and immersing it in a solution for deposition, but hydrogen gas generating reaction occurs violently on the substrate surface due to the solution pH, thereby hampering efforts to form a complete coating.

According to one aspect of the present invention, therefore, it is an object to rapidly form oxide and/or hydroxide films unachievable by the prior art, on metal materials with various surface shapes without heat treatment or with only low-temperature heat treatment, and to thereby provide metal oxide and/or metal hydroxide coated metal materials.

In the liquid phase method known as liquid phase deposition, wherein an aqueous fluorine compound solution such as fluoro-complex ion is used, the low film formation speed, resulting in a long time of several dozen minutes for film formation, has been a drawback as described in the examples of Japanese Patent No. 2828359 and elsewhere.

According to a second aspect of the invention, therefore, it is an object to rapidly form oxide and/or hydroxide films unachievable by the prior art, on conductive materials without heat treatment or with only low-temperature heat treatment, and to thereby provide metal oxide and/or metal hydroxide coated conductive materials.

DISCLOSURE OF THE INVENTION

The present inventors have made the following discovery after conducting diligent research to achieve the objects stated above.

In a treatment solution according to the first aspect of the invention, consumption and reduction of fluorine ions and hydrogen ions is thought to promote the reaction of metal ions to oxides and/or hydroxides. For example, when the metal material is immersed, local cells are formed on its surface causing metal elution and hydrogen generating reaction. Consumption of fluorine ions and reduction of hydrogen ions occurring by the eluted metal ions causes oxides and/or hydroxides to be deposited on the metal material surface. Either or both the metal elution reaction and hydrogen reduction reaction are necessary for the film forming reaction to proceed, but excessive metal elution reaction can cause deterioration of the substrate, while excessive hydrogen generation can also prevent complete film formation or inhibit the deposition reaction. For this reason, it is necessary to determine the conditions that will suppress these reactions to a certain degree and promote the deposition reaction. For example, if the treatment solution pH is too low, immersion of the substrate can result in violent metal elution reaction and hydrogen reduction reaction, such that no deposit forms and the substrate becomes corroded.

Thus when considering the film formability, it is clearly a requirement to control the hydrogen generating and metal ion elution and deposition reactions, or in other words, to control the pH of the solution bath to within a suitable range. Moreover, by shorting the substrate and the metal material having a lower standard electrode potential, the hydrogen generating reaction will occur at the substrate and the metal elution reaction will occur at the metal material with a lower standard electrode potential, thereby suppressing corrosion of the substrate metal material. In this case as well, however, film formation is still inhibited by the hydrogen reduction reaction at the substrate, and therefore the pH of the solution bath must obviously be set to within a suitable range. In addition, it was found that when the low standard electrode potential material is shorted before immersing the substrate, a higher film forming rate is achieved than by simply immersing the substrate. This is believed to be because in the latter case, metal elution reaction shifts to deposition reaction thereby causing the eluted ion concentration to be reduced by film formation, whereas with shorting, the metal elution reaction and deposition reaction occur in independent reaction zones such that elution of the metal ion proceeds constantly.

The first aspect of the invention is therefore as follows:

(1) A method for production of a metal oxide and/or metal hydroxide coated metal material characterized by immersing a metal material in an aqueous treatment solution at pH 2-7 containing a metal ion and a fluorine ion in a 4-fold or more molar ratio with respect to the metal ion, and/or containing a complex ion comprising at least a metal and fluorine in a 4-fold or more molar ratio with respect to the metal, to form on the surface of the metal material a metal oxide and/or metal hydroxide coating whose metal consists of the metal of the metal ion and/or the metal.

(2) A method for production of a metal oxide and/or metal hydroxide coated metal material according to (1) above, wherein a plurality of aqueous treatment solutions containing different metal ions are used to form a coating composed of a plurality metal oxide and/or metal hydroxide coatings, (3) A method for production of a metal oxide and/or metal hydroxide coated metal material according to (1) or (2) above, wherein the aqueous treatment solution contains a plurality of metal ions, (4) A method for production of a metal oxide and/or metal hydroxide coated metal material according to (1) to (3) above, wherein a plurality of aqueous treatment solutions with different concentrations of the plurality of metal ions are used to form a graded concentration coating, (5) A method for production of a metal oxide and/or metal hydroxide coated metal material according to (1) to (4) above, wherein the aqueous treatment solution further contains a metal ion that does not form and/or is modified not to form a complex with fluorine, (6) A method for production of a metal oxide and/or metal hydroxide coated metal material according to (1) to (5) above, wherein the aqueous treatment solution is an aqueous solution containing a fluoro-metal complex compound, (7) A method for production of a metal oxide and/or metal hydroxide coated metal material according to (1) to (6) above, wherein the pH of the aqueous treatment solution is 3-4, (8) A method for production of a metal oxide and/or metal hydroxide coated metal material according to (1) to (7) above, wherein the metal material is immersed in the aqueous treatment solution with shorting to a metal material having a lower standard electrode potential than the metal material, (9) A coated metal material characterized by having a metal oxide and/or metal hydroxide coating obtained by the method of (1) to (8) above, on a metal material surface.

(10) A metal oxide and/or metal hydroxide coated metal steel sheet according to (9) above, wherein said metal material is a stainless steel sheet with a sheet thickness of 10 μm or greater.

(11) A metal oxide and/or metal hydroxide coated metal sheet according to (9) above, wherein said metal material is a steel sheet or plated steel sheet.

(12) A metal oxide and/or metal hydroxide coated metal sheet according to (11) above, wherein said plated steel sheet is a plated steel sheet with a plating layer composed mainly of zinc and/or aluminum.

In a treatment solution according to the second aspect of the invention, either or both the reactions of consumption of fluorine ions and reduction of hydrogen ions are thought to promote the reaction of metal ions to oxides and/or hydroxides, resulting in deposition on the metal material surface.

If the anodic reaction and cathodic reaction of the insoluble material and the substrate to be deposited are controlled, then hydrogen ion reduction reaction will occur on the substrate and progress of the reactions and increasing pH at the interface will result in deposition of the metal oxide and/or metal hydroxide. It was surmised that the deposition rate may be increased if the hydrogen generating reaction and interface pH increase can be controlled in a range that does not inhibit film formation. Boron ion or aluminum ion may also be added to the treatment solution to form stabler fluorides against fluorine ion consumption. It was thus confirmed that a uniform coating can be formed in a short time by controlling the potential to a level which does not inhibit the deposition reaction by hydrogen gas generation. If the treatment solution pH is too low, the hydrogen reduction reaction tends to occur violently, and it therefore became clear that setting the pH of the solution bath to within a suitable range can facilitate control of the potential. That is, control of the hydrogen generating reaction allowed the deposition rate to be dramatically increased.

The second aspect of the invention is therefore as follows:

(13) A method for production of a metal oxide and/or metal hydroxide coated conductive material characterized by electrolyzing a conductive material in an aqueous treatment solution at pH 2-7 containing a metal ion and a fluorine ion in a 4-fold or more molar ratio with respect to the metal ion, and/or containing a complex ion comprising at least a metal and fluorine in a 4-fold or more molar ratio with respect to the metal, to form on the surface of the conductive material a metal oxide and/or metal hydroxide coating containing the metal ion and/or said metal.

(14) A method for production of a metal oxide and/or metal hydroxide coated conductive material according to (13) above, wherein a plurality of aqueous treatment solutions containing different metal ions are used to form a coating composed of a plurality of metal oxide and/or metal hydroxide coatings,

(15) A method for production of a metal oxide and/or metal hydroxide coated conductive material according to (13) or (14) above, wherein the aqueous treatment solution contains a plurality of metal ions,

(16) A method for production of a metal oxide and/or metal hydroxide coated conductive material according to (13) to (15) above, wherein a plurality of aqueous treatment solutions with different concentrations of the plurality of metal ions are used to form a graded concentration coating,

(17) A method for production of a metal oxide and/or metal hydroxide coated conductive material according to (13) to (16) above, wherein the aqueous treatment solution further contains a metal ion that does not form and/or is modified not to form a complex with fluorine,

(18) A method for production of a metal oxide and/or metal hydroxide coated conductive material according to (13) to (17) above, wherein the aqueous treatment solution is an aqueous solution containing a fluoro-metal complex compound,

(19) A method for production of a metal oxide and/or metal hydroxide coated conductive material according to (13) to (18) above, wherein the pH of the aqueous treatment solution is 3-4,

(20) A method for continuous production of a metal oxide and/or metal hydroxide coating on a conductive material according to (13) to (19) above, wherein the method of electrolysis of said conductive material comprises filling an electrode solution between the conductive surface of said conductive material and an electrode set opposite thereto, contacting conductor rolls with the conductive surface of the conductive material and applying a voltage with said conductor roll side as the negative electrode and said electrode side as the positive electrode.

(21) A method for continuous production of a metal oxide and/or metal hydroxide coating on a conductive material according to (13) to (19) above, wherein the method of electrolysis of said conductive material comprises setting two systems of electrodes opposing the conductive surface of said conductive material, in the direction of movement of the conductive material, filling an electrode solution between said conductive material and said electrode group and applying a voltage with the one electrode system side as the negative electrode and the other system electrode side as the positive electrode.

(22) A metal oxide and/or metal hydroxide coated conductive material characterized by having a metal oxide and/or metal hydroxide coating obtained by the method of (13) to (21) above, on a conductive material surface,

(23) A metal oxide and/or metal hydroxide coated conductive material according to (22) above, wherein the electrical conductivity of the conductive material is at least 0.1 S/cm.

(24) A metal oxide and/or metal hydroxide coated conductive material sheet according to (22) above, wherein said metal material is a stainless steel sheet with a sheet thickness of 10 μm or greater.

(25) A metal oxide and/or metal hydroxide coated conductive material according to (22) above, wherein said metal material is a steel sheet or plated steel sheet.

(26) A metal oxide and/or metal hydroxide coated conductive material sheet according to (25) above, wherein said metal material is a plated steel sheet with a plating layer composed mainly of zinc and/or aluminum.

BRIEF DESCRIPTION PF THE DRAWINGS

BEST MODE FOR CARRYING OUT THE INVENTION

Figure 1:
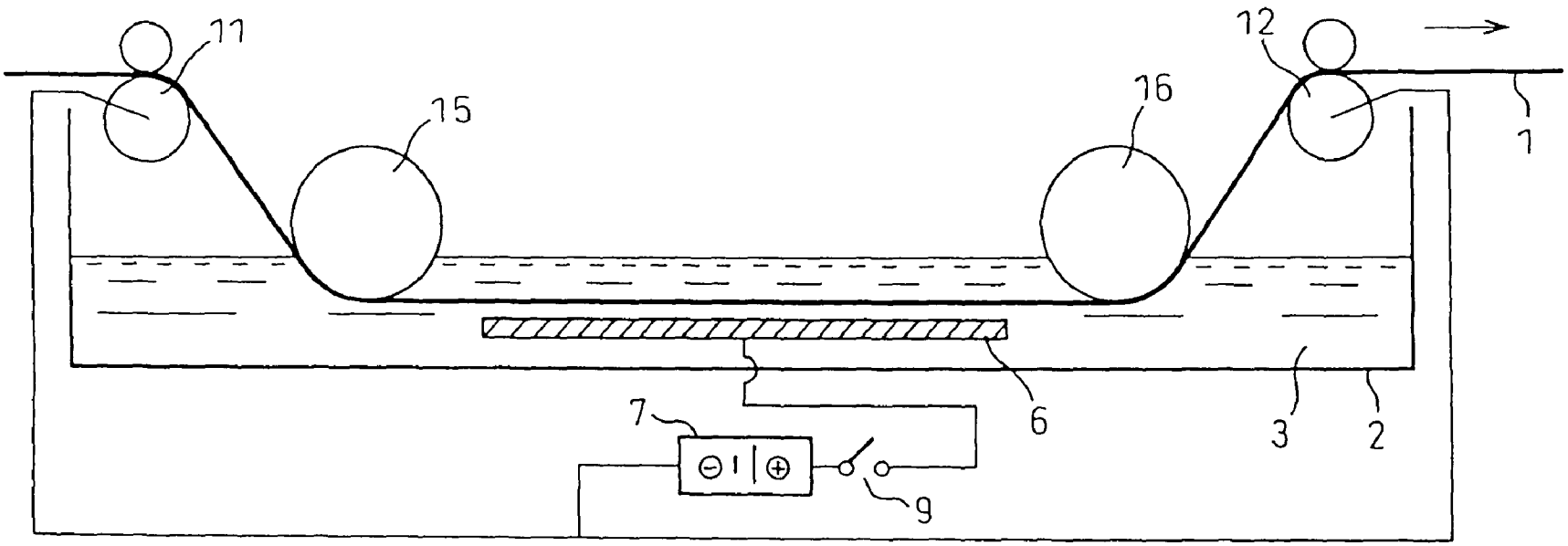
FIG. 1 is a schematic view of an apparatus for direct electrolytic one-sided coating.

The present invention will now be explained in greater detail.

The first aspect of the invention will be explained first.

An equilibrium reaction between the metal ion and oxygen and/or hydroxide in which fluorine ion participates occurs in the aqueous solution containing metal ion and fluorine ion in a 4-fold or more molar ratio with respect to the metal ion, and/or in the aqueous solution containing a complex ion comprising a metal and fluorine in a 4-fold or more molar ratio with respect to the metal. Consumption and reduction of the fluorine ion and hydrogen ion is thought to promote the reaction of metal ions to oxides and/or hydroxides, and therefore the pH of the treatment solution was examined with particular interest. As a result, it was found that a treatment solution pH of 2-7 is preferred, and a pH of 3-4 is more preferred. If the treatment solution pH is less than 2, the metal ion elution reaction and hydrogen reduction reaction occur violently, causing corrosion of the substrate and inhibiting formation of the film by hydrogen generation, such that a complete film cannot be formed. On the other hand, if the pH is greater than 7, the solution becomes unstable or deposition of aggregates may occur, resulting in insufficient cohesion. Shorting between the substrate and the metal material having a lower standard electrode potential can cause hydrogen generating reaction on the substrate and metal elution reaction on the metal material having a lower standard electrode potential, and in this case as well it was found that the aforementioned pH range is ideal in order to suppress corrosion of the substrate metal material. Furthermore, the film formation rate can be increased by up to about 5-fold compared to simple immersion, although this depends on the conditions such as the combination of substrate and shorting metal, and the temperature. No deposition was seen when the molar ratio of fluorine ion with respect to the metal ion in the treatment solution was less than 4-fold. It was also found that the deposition rate can be controlled by the salt concentration, temperature and by addition of organic substances for the purpose of suppressing or promoting hydrogen generating reaction on the substrate surface.

Metal ions to be used according to the first aspect of the invention include Ti, Si, Zr, Fe, Sn, Nd and the like, but are not limited thereto.

The concentration of the metal ion in the treatment solution depends on the kind of metal ion but the reasons therefor are not clear.

The fluorine ion used according to the first aspect of the invention may be hydrofluoric acid or a salt thereof, for example, an ammonium, potassium or sodium salt, but is not limited thereto. When a salt is used, the saturation solubility-depehds on the kind of cation, and selection should be made considering the film formation concentration range.

Complex ions with a metal and fluorine in a 4-fold or more molar ratio with respect to the metal may be provided by, for example, hexafluorotitanic acid, hexafluorozirconic acid, hexafluorosilicic acid, or their salts, such as ammonia, potassium and sodium salts, but are not limited thereto. This complex ion may be "a complex ion bonding at least a metal ion and a compound containing fluorine in a 4-fold or more molar ratio with respect to the metal "ion". That is, the complex ion may contain, in addition to a metal and fluorine, other element or atom or ion. When a salt is used, the saturation solubility depends on the kind of cation, selection should be made considering the film formation concentration range.

When the concentration of the complex ion with a metal and fluorine is less than 4-fold in molar ratio with respect to the metal in the treatment solution, deposition does not occur.

The adjustment of the pH of the solution can be made by known method but, when fluoric acid is used, the ratio between the metal ion and the fluorine ion is also varied and the final fluorine ion concentration in the treatment aqueous solution should be controlled.

There are no particular restrictions on the other conditions for the deposition reaction according to the invention. The reaction temperature and reaction time may be selected appropriately. Increase in temperature causes increase in film formation rate. The film thickness (film formation amount) can be controlled by reaction time period.

The film thickness of the metal oxide and/or hydroxide coating formed on the surface of the metal material according to the first aspect of the invention may be selected depending on the applications and from a range by characteristics and economy.

In accordance with the present invention, any variety of oxide coatings that can be formed by all conventional oxide coating formation methods (liquid methods and gaseous methods) can be formed. For example, there can be mentioned, (2) formation of a coating comprising a plurality of different metal oxide and/or metal hydroxide coatings, (3) by containing a plurality of metal ions in the treatment aqueous solution, formation of a composite oxide coating and/or a coating in which different oxides are two dimensionally distributed, (4) formation of a concentration graded coating by using a plurality of different treatment solutions with different concentrations of different metal ions, for example, a coating made of two oxides in which the main oxides are different near the interface to the substrate and on the surface of the coating and the molar ratio of the oxides gradually varys therebetween, and (5) formation of a coating in which metal or metal oxide is finely dispersed, by containing a metal ion that does not form or is modified not to form a complex with fluorine.

The metal material used for the first aspect of the invention is not particularly restricted, and for example, various metals, alloys or metal surface treated materials and the like may be employed. It may be in the form of a plate, foil, wire, rod or the like, or even worked into a complex shape such as mesh or etched surface.

The metal oxide and/or metal hydroxide coated metal material may be used for a variety of purposes, including an oxide catalyst electrode for a capacitor formed on the surface of a stainless steel foil, various types of steel sheets with improved corrosion resistance, various types of steel sheets with improved resin/metal cohesion, various substrates with imparted photocatalytic properties, insulating films formed on stainless steel foils for solar cells, EL displays, electron papers, designed coatings, and metal materials with slidability for improved workability.

The second aspect of the invention will now be explained.

An equilibrium reaction between the metal ion and oxygen and/or hydroxide in which fluorine ion participates occurs in the aqueous solution containing metal ion and fluorine ion in a 4-fold or more molar ratio with respect the metal ion, and/or in the aqueous solution containing a complex of a metal ion and fluorine in a 4-fold or more molar ratio with respect to the metal ion. Consumption and reduction of the fluorine ion and hydrogen ion is thought to promote the reaction of metal ions to oxides and/or hydroxides. While deposition occurs very slowly when the substrate for deposition is simply immersed in the treatment solution, the deposition rate was dramatically increased by immersing the insoluble electrode and applying a cathode over-voltage of from a few mV to a few hundred mV to the substrate for deposition. When the substrate surface was observed at this time, generation of hydrogen gas was seen but a highly homogeneous coating had been formed. Nevertheless, when the pH of the treatment solution was further lowered to promote this gas generation, no coating was formed or only a non-uniform or low-cohesion coating could be formed. The pH of the treatment solution was therefore examined with particular interest, and as a result it was found that a treatment solution pH of 2-7 is preferred, and a pH of 3-4 is more preferred. If the treatment solution pH is less than 2, formation of the film tends to be inhibited by hydrogen generation, such that control of the potential for formation of a complete film becomes difficult. On the other hand, if the pH is greater than 7, the solution becomes unstable or deposition of aggregates may occur, resulting in insufficient cohesion. No deposition was seen when the molar ratio of fluorine ion with respect to the metal ion in the treatment solution was less than 4-fold. It was also found that the deposition rate can be controlled by the salt concentration, temperature and by addition of organic substances for the purpose of suppressing or promoting hydrogen generating reaction on the substrate surface.

The metal ion, fluorine ion, fluorine-containing complex ion, pH adjustment, deposition conditions, film thickness and he like used in the second aspect of the present invention can be similar to those of the first aspect of the present invention.

The electrolysis conditions according to the invention can be any ones which allow cathod electrolysis of a substrate. The details are described in Examples or other places. The film formation rate can be controlled by current. The film thickness can be controlled by the product of the current and the time period, i.e., the quantity of electricity. The optimum and upper limits of the current and voltage differ depending on the type of oxide and concentration.

The conductive material used for the second aspect of the invention is not particularly restricted, and for example, conductive polymers, conductive ceramics, various metals or alloys, and various metal surface treated materials may be used. It may be in the form of a sheet, foil, wire, rod or the like, or may be worked into a complex shape such as mesh or etched surface. A film can be formed on the substrate so long as there is conductivity, but the conductivity is preferably at 0.1 S/cm. With a lower conductivity the resistance increases, resulting in lower deposition efficiency.

FIG. 1 is a schematic view of an apparatus for continuous formation of a metal oxide and/or metal hydroxide film on a material having an electrolytic mask (not shown) on the surface of one side and conductive on the surface of the other side. It will be appreciated that the apparatus will in fact be more complex than shown in this illustration.

The major construction has an electrolyte solution 3 filled between conductor rolls 11, 12 in contact with the surface of a continuously transported conductive material 1 having an electrolytic mask selectively formed on the surface of the other side and an electrode 6 set opposite the conductive surface of the conductive material 1, while a direct current power device 7 is situated between the conductor rolls 11,12 and electrode 6 with the conductor rolls side as the negative electrode and the electrode side as the positive electrode. A switch 9 is set between the current power device 7 and the conductor rolls 11,12, and closing of the switch 9 applies a voltage between the conductor rolls 11,12 and the electrode 6. opening the switch 9 cuts off the voltage application.

A ringer roll (not shown) is situated at the introduction side of the electrolyte bath 2 as a transport roll for the conductive material 1 for control of the flow of the electrolyte solution 3 out of the bath, while sink rolls 15,16 are situated in the bath to maintain a constant distance between the electrode 6 and the conductive material 1.

Figure 2:
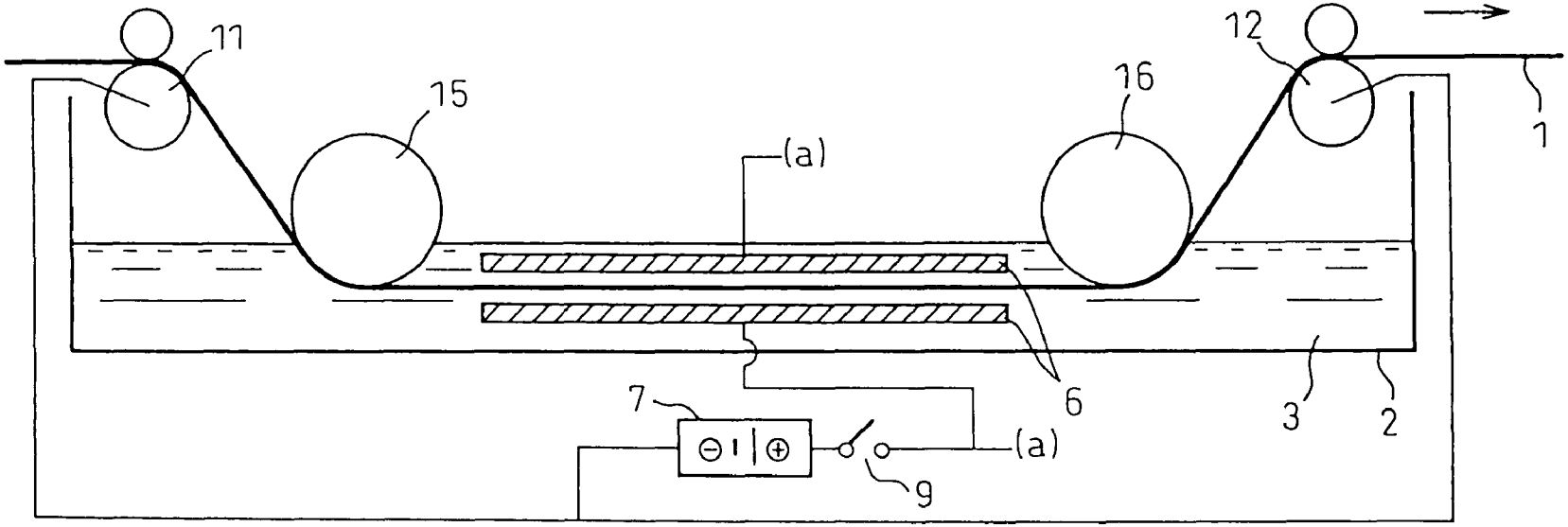
FIG. 2 is a schematic view of an apparatus for direct electrolytic double-sided coating.

FIG. 2 shows a schematic of an apparatus for formation of a metal oxide and/or metal hydroxide film on a material which is conductive on both surfaces. The explanation is the same as for FIG. 1, except that electrodes are set mutually opposite each other on the front and back sides of the conductive material 1.

Figure 3:
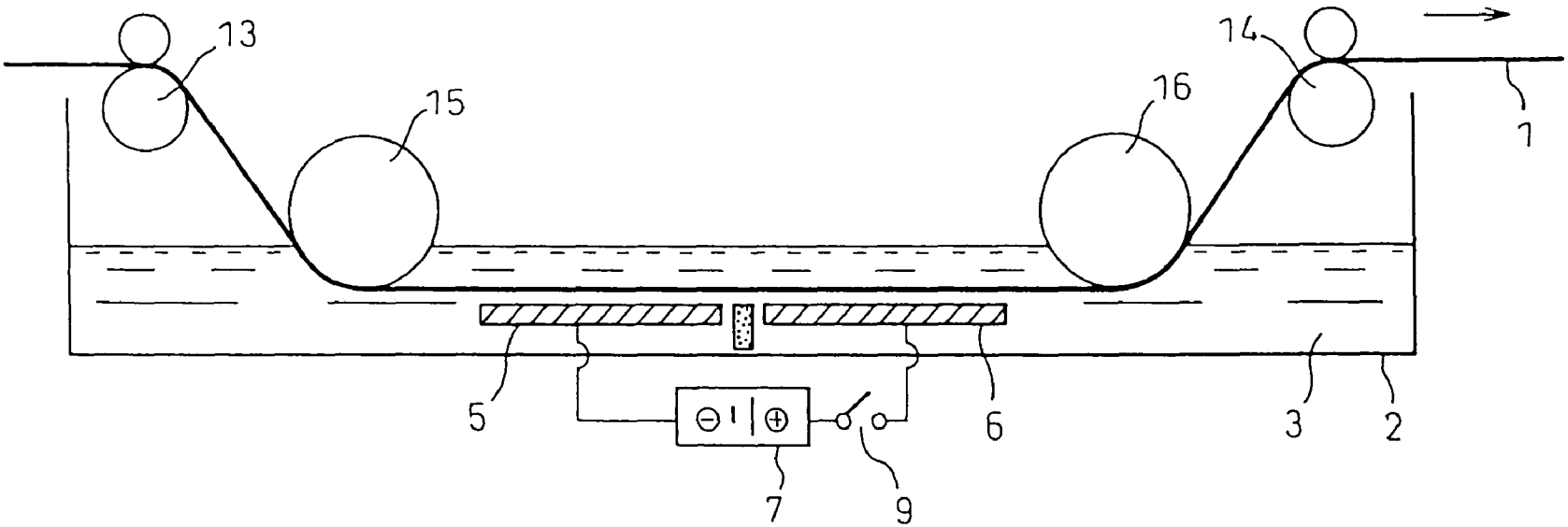
FIG. 3 is a schematic view of an apparatus for indirect electrolytic one-sided coating.

FIG. 3 shows a schematic of an apparatus for continuous formation of a metal oxide and/or metal hydroxide film on a material having an electrolytic mask (not shown) on the surface of one side and being conductive on the surface of the other side. It will be appreciated that the apparatus will in fact be more complex than shown in this illustration.

The major construction has electrodes 5 and 6 successively situated along the direction of movement of a conductive material 1 opposite the conductive surface of a continuously transported conductive material 1 having an electrolytic mask selectively formed on the surface of the other side, with an electrolyte solution 3 filled between the conductive material 1 and the electrodes 5 and 6, while a direct current power device 7 is situated between the electrodes 5 and 6 with the electrode 5 side as the negative electrode and the electrode 6 side as the positive electrode. A switch 9 is set between the current power device 7 and the electrode 6, and closing of the switch 9 applies a voltage between the electrode 5 and the electrode 6. Opening the switch 9 cuts off the voltage application. Also, ringer rolls 13,14 are situated at the introduction side of the electrolyte bath 2 as transport rolls for the conductive material 1 for control of the flow of the electrolyte solution 3 out of the bath, while sink rolls 15,16 are situated in the bath to maintain a constant distance between the electrodes 5 and 6 and the conductive material 1.

Figure 4:
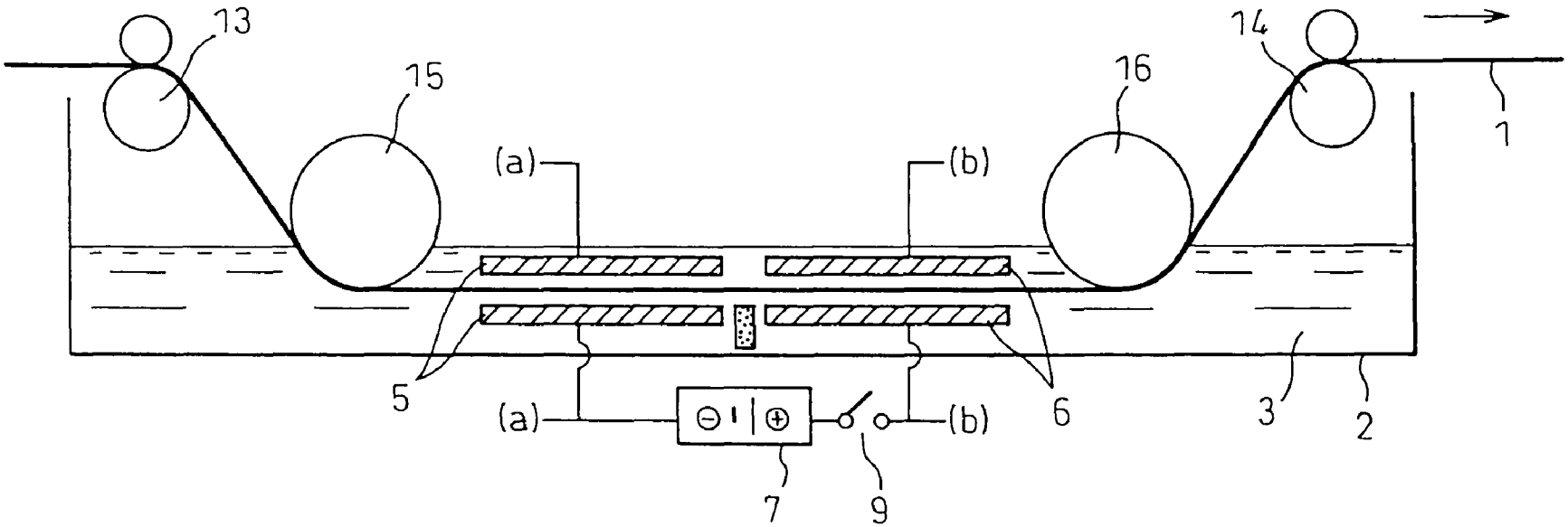
FIG. 4 is a schematic view of an apparatus for indirect electrolytic double-sided coating.

FIG. 4 shows a schematic of an apparatus for formation of a metal oxide and/or metal hydroxide film on a material which is conductive on both surfaces. The explanation is the same as for FIG. 3, except that electrodes are set mutually opposite each other on the front and back sides of the conductive material 1.

The metal oxide and/or metal hydroxide coated conductive material may be used for a variety of purposes, including improved corrosion resistance of capacitor oxide catalyst electrodes formed on conductive rubber or stainless steel foil surfaces or of various types of steel sheets, improved resin/metal cohesion, for imparting photocatalytic properties to substrates, or for improving workability by providing slidability for insulating films, design coatings or metal materials formed on stainless steel foils, such as in solar cells, EL displays, electron paper substrates and the like.

EXAMPLES

The invention will now be explained in further detail through examples.

Example 1

This example illustrates the first aspect of the invention.

Different treatment solutions were used to form films in the manner described below, and the deposition states were evaluated. The substrates, treatment solutions, treatment conditions and results are shown in Tables 1 and 2.

The deposition state was evaluated by visual observation of the condition after film formation and after 90° bending, with ○ indicating absence of peeling, and x indicating presence of peeling. The surface condition was evaluated by scanning electron microscope observation at 5000× magnification, and evaluation was made based on 4 arbitrarily selected locations, with x indicating cracks at 2 or more locations, ○ indicating a crack at 1 location, and ◎ indicating no cracks. When necessary, the cross-section was observed to examine the coating structure.

The substrate for film formation was designated as metal material A, and the metal with a lower standard electrode potential than metal material A was designated as metal material B.

[Experiment Nos. 1-6]

The treatment solutions used were mixed 0.1 M aqueous solutions of titanium chloride and ammonium hydrogen fluoride at titanium ion/fluorine ion molar ratios of 1:1, 1:2, 1:3, 1:4, 1:5 and 1:6, with the pH adjusted to 3 using hydrofluoric acid and ammonia water. Aluminum was used as the substrate metal material A. The film formation was carried out for 5 minutes at room temperature, and the film formation was followed by water rinsing and air drying.

[Experiment Nos. 7-13]

The treatment solutions used were 0.1 M aqueous solutions of ammonium hexafluorotitanate, with the pH adjusted to 1, 3, 5, 7 and 9 using hydrofluoric acid and ammonia water. Aluminum was used as the substrate metal material A. The film formation was carried out for 5 minutes at room temperature, and the film formation was followed by water rinsing and air drying. Adjustment to pH 3 was carried out at bath temperatures of 50° C. and 80° C.

[Experiment Nos. 14-18]

The treatment solutions used were 0.1 M aqueous solutions of ammonium hexafluorozirconate, with the pH adjusted to 1, 3, 5, 7 and 9 using hydrofluoric acid and ammonia water. Aluminum was used as the substrate metal material A. The film formation was carried out for 5 minutes at room temperature, and the film formation was followed by water rinsing and air drying.

[Experiment Nos. 19-24]

The treatment solutions used were mixed 0.1 M aqueous solutions of titanium chloride and ammonium hydrogen fluoride at titanium ion/fluorine ion molar ratios of 1:1, 1:2, 1:3, 1:4, 1:5 and 1:6, with the pH adjusted to 3 using hydrofluoric acid and ammonia water. Stainless steel (SUS304) was used as the substrate metal material A, and aluminum was used as metal material B. The film formation was carried out for 5 minutes at room temperature, and the film formation was followed by water rinsing and air drying.

[Experiment Nos. 25-29]

The treatment solutions used were 0.1 M aqueous solutions of ammonium hexafluorotitanate, with the pH adjusted to 1, 3, 5, 7 and 9 using hydrofluoric acid and ammonia water. Stainless steel (SUS304) was used as the substrate metal material A, and aluminum was used as metal material B. The film formation was carried out for 5 minutes at room temperature, and the film formation was followed by water rinsing and air drying.

[Experiment Nos. 30-34]

The treatment solutions used were 0.1 M aqueous solutions of ammonium hexafluorosilicate, with the pH adjusted to 1, 3, 5, 7 and 9 using hydrofluoric acid and ammonia water. Stainless steel (SUS304) was used as the substrate metal material A, and aluminum was used as metal material B. The film formation was carried out for 5 minutes at room temperature, and the film formation was followed by water rinsing and air drying.

[Experiment No. 35]

The first layer treatment solution used was an aqueous solution of 0.1 M ammonium hexafluorotitanate with the pH adjusted to 3. Pure iron was used as the substrate metal material A, and zinc was used as metal material B. The film formation was carried out for 2.5 minutes at room temperature, and the film formation was followed by water rinsing and air drying. The second layer treatment solution used was an aqueous solution of 0.1 M ammonium hexafluorosilicate with the pH adjusted to 3. Likewise, zinc was used as metal material B. The film formation was carried out for 2.5 minutes at room temperature, and the film formation was followed by water rinsing and air drying.

[Experiment No. 36]

The first layer treatment solution used was an aqueous solution of 0.1 M ammonium hexafluorotitanate with the pH adjusted to 3. Pure iron was used as the substrate metal material A, and zinc was used as metal material B. The film formation was carried out for 1 minute at room temperature, and the film formation was followed by water rinsing and air drying. The 2nd, 3rd, 4th and 5th layer treatment solutions used were, respectively, an aqueous solution of 0.08 M ammonium hexafluorotitanate and 0.02 M ammonium hexafluorosilicate, an aqueous solution of 0.06 M ammonium hexafluorotitanate and 0.04 M ammonium hexafluorosilicate, an aqueous solution of 0.04 M ammonium hexafluorotitanate and 0.06 M ammonium hexafluorosilicate and an aqueous solution of 0.02 M ammonium hexafluorotitanate and 0.08 M ammonium hexafluorosilicate, each with the pH adjusted to 3. Likewise, zinc was used as metal material B. The film formation was carried-out for 1 minute at room temperature, and the film formation was followed by water rinsing and air drying.

[Experiment No. 37]

After adding and dissolving 1 wt % of zinc chloride in an aqueous solution of 0.1 M ammonium hexafluorotitanate, the pH was adjusted to 3 for use as the treatment solution. Pure iron was used as the substrate metal material A, and zinc was used as metal material B. The film formation was carried out for 5 minutes at room temperature, and the film formation was followed by water rinsing and air drying.

[Experiment No. 38]

After adding and dissolving 1 wt % of gold chloride in an aqueous solution of 0.1 M ammonium hexafluorotitanate, the pH was adjusted to 3 for use as the treatment solution. Pure iron was used as the substrate metal material A, and zinc was used as metal material B. The film formation was carried out for 5 minutes at room temperature, and the film formation was followed by water rinsing and air drying.

[Experiment No. 39]

After adding and dissolving 1 wt % of palladium chloride in an aqueous solution of 0.1 M ammonium hexafluorotitanate, the pH was adjusted to 3 for use as the treatment solution. Pure iron was used as the substrate metal material A, and zinc was used as metal material B. The film formation was carried out for 5 minutes at room temperature, and the film formation was followed by water rinsing and air drying.

[Experiment No. 40]

An aqueous EDTA-cerium complex solution in which reaction with fluorine ion is masked by ethylenediamine tetraacetic acid (EDTA) was added to a 0.1 M-ammonium hexafluorotitanate aqueous solution for use as the treatment solution. Pure iron was used as the substrate metal material A and zinc was used as the metal material B. The film formation was carried out for 5 minutes at room temperature, and the film formation was followed by water rinsing and air drying.

TABLE 1

| | Metal material | | Treatment solution | | | | Result | | |
|---|---|---|---|---|---|---|---|---|---|
| Exp. No. | A (substrate) | B | Treatment solution type | Solution temperature | pH | Time | Deposition state | Surface condition | Note |
| 1 | Aluminum | — | 0.1 M titanium chloride + 0.05 M ammonium hydrogen fluoride (Ti:F (molar ratio) = 1:1) | Room temperature | 3 | 5 min | x | x | Comp. Ex. |
| 2 | Aluminum | — | 0.1 M titanium chloride + 0.1 M ammonium hydrogen fluoride (Ti:F (molar ratio) = 1:2) | Room temperature | 3 | 5 min | x | x | Comp. Ex. |
| 3 | Aluminum | — | 0.1 M titanium chloride + 0.15 M ammonium hydrogen fluoride (Ti:F (molar ratio) = 1:3) | Room temperature | 3 | 5 min | x | x | Comp. Ex. |
| 4 | Aluminum | — | 0.1 M titanium chloride + 0.2 M ammonium hydrogen fluoride (Ti:F (molar ratio) = 1:4) | Room temperature | 3 | 5 min | ○ | ○ | Example |
| 5 | Aluminum | — | 0.1 M titanium chloride + 0.25 M ammonium hydrogen fluoride (Ti:F (molar ratio) = 1:5) | Room temperature | 3 | 5 min | ○ | ○ | Example |
| 6 | Aluminum | — | 0.1 M titanium chloride + 0.3 M ammonium hydrogen fluoride (Ti:F (molar ratio) = 1:6) | Room temperature | 3 | 5 min | ○ | ○ | Example |
| 7 | Aluminum | — | 0.1 M ammonium hexafluorotitanate | Room temperature | 1 | 5 min | x | x | Comp. Ex. |
| 8 | Aluminum | — | 0.1 M ammonium hexafluorotitanate | Room temperature | 3 | 5 min | ○ | ○ | Example |
| 9 | Aluminum | — | 0.1 M ammonium hexafluorotitanate | 50° C. | 3 | 5 min | ○ | ○ | Example |
| 10 | Aluminum | — | 0.1 M ammonium hexafluorotitanate | 80° C. | 3 | 5 min | ○ | ○ | Example |
| 11 | Aluminum | — | 0.1 M ammonium hexafluorotitanate | Room temperature | 5 | 5 min | ○ | ○ | Example |
| 12 | Aluminum | — | 0.1 M ammonium hexafluorotitanate | Room temperature | 7 | 5 min | ○ | ○ | Example |
| 13 | Aluminum | — | 0.1 M ammonium hexafluorotitanate | Room temperature | 9 | 5 min | x | x | Comp. Ex. |
| 14 | Aluminum | — | 0.1 M potassium hexafluorozirconate | Room temperature | 1 | 5 min | x | x | Comp. Ex. |
| 15 | Aluminum | — | 0.1 M potassium hexafluorozirconate | Room temperature | 3 | 5 min | ○ | ○ | Example |
| 16 | Aluminum | — | 0.1 M potassium hexafluorozirconate | Room temperature | 5 | 5 min | ○ | ○ | Example |
| 17 | Aluminum | — | 0.1 M potassium hexafluorozirconate | Room temperature | 7 | 5 min | ○ | ○ | Example |
| 18 | Aluminum | — | 0.1 M potassium hexafluorozirconate | Room temp. | 9 | 5 min | x | x | Comp. Ex. |
| 19 | Stainless steel (SUS304) | Aluminum | 0.1 M titanium chloride + 0.05 M ammonium hydrogen fluoride (Ti:F (molar ratio) = 1:1) | Room temp. | 3 | 5 min | x | x | Comp. Ex. |
| 20 | Stainless steel (SUS304) | Aluminum | 0.1 M titanium chloride + 0.1 M ammonium hydrogen fluoride (Ti:F (molar ratio) = 1:2) | Room temp. | 3 | 5 min | x | x | Comp. Ex. |
| 21 | Stainless steel (SUS304) | Aluminum | 0.1 M titanium chloride + 0.15 M ammonium hydrogen fluoride (Ti:F (molar ratio) = 1:3) | Room temp. | 3 | 5 min | x | x | Comp. Ex. |
| 22 | Stainless steel (SUS304) | Aluminum | 0.1 M titanium chloride + 0.2 M ammonium hydrogen fluoride (Ti:F (molar ratio) = 1:4) | Room temp. | 3 | 5 min | ○ | ○ | Example |
| 23 | Stainless steel (SUS304) | Aluminum | 0.1 M titanium chloride + 0.25 M ammonium hydrogen fluoride (Ti:F (molar ratio) = 1:5) | Room temp. | 3 | 5 min | ○ | ○ | Example |
| 24 | Stainless steel (SUS304) | Aluminum | 0.1 M titanium chloride + 0.3 M ammonium hydrogen fluoride (Ti:F (molar ratio) = 1:6) | Room temp. | 3 | 5 min | ○ | ○ | Example |
| 25 | Stainless steel (SUS304) | Aluminum | 0.1 M ammonium hexafluorotitanate | Room temp. | 1 | 5 min | x | x | Comp. Ex. |
| 26 | Stainless steel (SUS304) | Aluminum | 0.1 M ammonium hexafluorotitanate | Room temp. | 3 | 5 min | ○ | ◎ | Example |
| 27 | Stainless steel (SUS304) | Aluminum | 0.1 M ammonium hexafluorotitanate | Room temp. | 5 | 5 min | ○ | ○ | Example |
| 28 | Stainless steel (SUS304) | Aluminum | 0.1 M ammonium hexafluorotitanate | Room temp. | 7 | 5 min | ○ | ○ | Example |
| 29 | Stainless steel (SUS304) | Aluminum | 0.1 M ammonium hexafluorotitanate | Room temp. | 9 | 5 min | x | x | Comp. Ex. |

TABLE 1-continued

| Exp. No. | Metal material A (substrate) | Metal material B | Treatment solution type | Treatment solution: Solution temperature | Treatment solution: pH | Treatment solution: Time | Result: Deposition state | Result: Surface condition | Note |
|---|---|---|---|---|---|---|---|---|---|
| 30 | Stainless steel (SUS304) | Aluminum | 0.1 M ammonium hexafluorosilicate | Room temp. | 1 | 5 min | x | x | Comp. Ex. |
| 31 | Stainless steel (SUS304) | Aluminum | 0.1 M ammonium hexafluorosilicate | Room temp. | 3 | 5 min | ○ | ◎ | Example |
| 32 | Stainless steel (SUS304) | Aluminum | 0.1 M ammonium hexafluorosilicate | Room temp. | 5 | 5 min | ○ | ○ | Example |
| 33 | Stainless steel (SUS304) | Aluminum | 0.1 M ammonium hexafluorosilicate | Room temp. | 7 | 5 min | ○ | ○ | Example |
| 34 | Stainless steel (SUS304) | Aluminum | 0.1 M ammonium hexafluorosilicate | Room temp. | 9 | 5 min | x | x | Comp. Ex. |

TABLE 2

| Exp. No. | Metal material A (substrate) | Metal material B | Treatment solution type | Treatment solution: Solution temp. | Treatment solution: pH | Treatment solution: Additive | Treatment solution: Time | Result: Deposition state | Result: Surface condition | Result: Deposition structure | Note |
|---|---|---|---|---|---|---|---|---|---|---|---|
| 35 | Iron | Zinc | Layer 1: 0.1 M ammonium hexafluorotitanate | Room temp. | 3 | none | 2.5 min | ○ | ○ | Bilayer structure | Ex. |
| | | | Layer 2: 0.1 M ammonium hexafluorosilicate | Room temp. | 3 | none | 2.5 min | | | | |
| 36 | Iron | Zinc | Layer 1: 0.1 M ammonium hexafluorotitanate | Room temp. | 3 | none | 1 min | ○ | ○ | Laminated structure | Ex. |
| | | | Layer 2: 0.08 M ammonium hexafluorotitanate + 0.02 M ammonium hexafluorosilicate | Room temp. | 3 | none | 1 min | | | | |
| | | | Layer 3: 0.06 M ammonium hexafluorotitanate + 0.04 M ammonium hexafluorosilicate | Room temp. | 3 | none | 1 min | | | | |
| | | | Layer 4: 0.04 M ammonium hexafluorotitanate + 0.06 M ammonium hexafluorosilicate | Room temp. | 3 | none | 1 min | | | | |
| | | | Layer 5: 0.02 M ammonium hexafluorotitanate + 0.08 M ammonium hexafluorosilicate | Room temp. | 3 | none | 1 min | | | | |
| 37 | Iron | Zinc | 0.1 M ammonium hexafluorotitanate | Room temp. | 3 | 1% zinc chloride | 5 min | ○ | ○ | Fine dispersed structure | Ex. |
| 38 | Iron | Zinc | 0.1 M ammonium hexafluorotitanate | Room temp. | 3 | 1% gold chloride | 5 min | ○ | ○ | Fine dispersed structure | Ex. |
| 39 | Iron | Zinc | 0.1 M ammonium hexafluorotitanate | Room temp. | 3 | 1% palladium chloride | 5 min | ○ | ○ | Fine dispersed structure | Ex. |
| 40 | Iron | Zinc | 0.1 M ammonium hexafluorotitanate | Room temp. | 3 | EDTA-cerium | 5 min | ○ | ○ | Fine dispersed structure | Ex. |

Example 2

This example illustrates the second aspect of the invention.

Different treatment solutions were used to form films in the manner described below, and the deposition states were evaluated. The substrates, treatment solutions, treatment conditions and results are shown in Tables 3 and 4.

The deposition state was evaluated by visual observation of the condition after film formation and after 90° bending, with ○ indicating absence of peeling, and x indicating presence of peeling. The surface condition was evaluated by scanning electron microscope observation at 5000× magnification, and evaluation was made based on 4 arbitrarily selected locations, with x indicating cracks at 2 or more locations, ○ indicating a crack at 1 location, and ◎ indicating no cracks. The mass was measured before and after deposition, and the difference was divided by the deposition area to calculate the amount of deposition per unit area. When necessary, the cross-section was observed to examine the coating structure.

[Experiment Nos. 101-106]

The treatment solutions used were mixed 0.1 M aqueous solutions of titanium chloride and ammonium hydrogen fluoride at titanium ion/fluorine ion molar ratios of 1:1, 1:2, 1:3, 1:4, 1:5 and 1:6, with the pH adjusted to 3 using hydrofluoric acid and ammonia water. Conductive rubber was used as the substrate, and platinum was used as the electrode material. The electrolysis film formation was carried out for 5 minutes at room temperature, and the film formation was followed by water rinsing and air drying (see Table 3).

[Experiment Nos. 107-113]

The treatment solutions used were 0.1 M aqueous solutions of ammonium hexafluorotitanate, with the pH adjusted to 1, 3, 5, 7 and 9 using hydrofluoric acid and ammonia water. Conductive rubber was used as the substrate, and platinum was used as the electrode material. The film formation was carried out for 5 minutes at room temperature, and the film formation was followed by water rinsing and air drying. Adjustment to pH 3 was carried out at bath temperatures of 50° C. and 80 ° C.

[Experiment Nos. 114-118]

The treatment solutions used were 0.1 M aqueous solutions of ammonium hexafluorozirconate, with the pH adjusted to 1, 3, 5, 7 and 9 using hydrofluoric acid and ammonia water. Conductive rubber was used as the substrate, and platinum was used as the electrode material. The film formation was carried out for 5 minutes at room temperature, and the film formation was followed by water rinsing and air drying.

[Experiment Nos. 119-124]

The treatment solutions used were mixed 0.1 M aqueous solutions of titanium chloride and ammonium hydrogen fluoride at titanium ion/fluorine ion molar ratios of 1:1, 1:2, 1:3, 1:4, 1:5 and 1:6, with the pH adjusted to 3 using hydrofluoric acid and ammonia water. Stainless steel (SUS304) was used as the substrate, and platinum was used as the electrode material. The film formation was carried out for 5 minutes at room temperature, and the film formation was followed by water rinsing and air drying.

[Experiment Nos. 125-129]

The treatment solutions used were 0.1 M aqueous solutions of ammonium hexafluorotitanate, with the pH adjusted to 1, 3, 5, 7 and 9 using hydrofluoric acid and ammonia water. Stainless steel (SUS304) was used as the substrate, and platinum was used as the electrode material. The film formation was carried out for 5 minutes at room temperature, and the film formation was followed by water rinsing and air drying.

[Experiment Nos. 130-134]

The treatment solutions used were 0.1 M aqueous solutions of ammonium hexafluorosilicate, with the pH adjusted to 1, 3, 5, 7 and 9 using hydrofluoric acid and ammonia water. Stainless steel (SUS304) was used as the substrate, and platinum was used as the electrode material. The film formation was carried out for 5 minutes at room temperature, and the film formation was followed by water rinsing and air drying.

[Experiment No. 135]

The first layer treatment solution used was an aqueous solution of 0.1 M ammonium hexafluorotitanate with the pH adjusted to 3. Pure iron was used as the substrate, and platinum was used as the electrode material. The film formation was carried out for 2.5 minutes at room temperature, and the film formation was followed by water rinsing and air drying. The second layer treatment solution used was an aqueous solution of 0.1 M ammonium hexafluorosilicate with the pH adjusted to 3. Each film formation was carried out for 2.5 minutes at room temperature, and the film formation was followed by water rinsing and air drying.

[Experiment No. 136]

The first layer treatment solution used was an aqueous solution of 0.1 M ammonium hexafluorotitanate with the pH adjusted to 3. Pure iron was used as the substrate, and platinum was used as the electrode material. The film formation was carried out for 1 minute at room temperature, and the film formation was followed by water rinsing and air drying. The 2nd, 3rd, 4th and 5th layer treatment solutions used were, respectively, an aqueous solution of 0.08 M ammonium hexafluorotitanate and 0.02 M ammonium hexafluorosilicate, an aqueous solution of 0.06 M ammonium hexafluorotitanate and 0.04 M ammonium hexafluorosilicate, an aqueous solution of 0.04 M ammonium hexafluorotitanate and 0.06 M ammonium hexafluorosilicate and an aqueous solution of 0.02 M ammonium hexafluorotitanate and 0.08 M ammonium hexafluorosilicate, each with the pH adjusted to 3. Each film formation was carried out for 1 minute at room temperature, and the film formation was followed by water rinsing and air drying.

[Experiment No. 137]

After adding and dissolving 1 wt % of zinc chloride in an aqueous solution of 0.1 M ammonium hexafluorotitanate, the pH was adjusted to 3 for use as the treatment solution. Pure iron was used as the substrate, and platinum was used as the electrode material. The film formation was carried out for 5 minutes at room temperature, and the film formation was followed by water rinsing and air drying.

[Experiment No. 138]

After adding and dissolving 1 wt % of gold chloride in an aqueous solution of 0.1 M ammonium hexafluorotitanate, the pH was adjusted to 3 for use as the treatment solution. Pure iron was used as the substrate, and platinum was used as the electrode material. The film formation was carried out for 5 minutes at room temperature, and the film formation was followed by water rinsing and air drying.

[Experiment No. 139]

After adding and dissolving 1 wt % of palladium chloride in an aqueous solution of 0.1 M ammonium hexafluorotitanate, the pH was adjusted to 3 for use as the treatment solution. Pure iron was used as the substrate, and platinum was used as the electrode material. The film formation was carried out for 5 minutes at room temperature, and the film formation was followed by water rinsing and air drying.

[Experiment No. 140]

An aqueous solution of 0.1 M ammonium hexafluorotitanate adjusted to pH 3 was used as the treatment solution. General purpose glass was used as the substrate. The film formation was carried out for 5 hours at room temperature, and the film formation was followed by water rinsing and air drying.

[Experiment No. 141]

An EDTA-cerium complex aqueous solution in which reaction with fluorine ion is blocked by ethylenediamine tetraacetic (EDTA) acid was added to a 0.1 M-ammonium hexafluorotitanate aqueous solution for use as treatment solution. Pure iron was used as the substrate metal material A and platinum was used as the electrode material. The film formation was carried out for 5 minutes at room temperature. The film formation was followed by water rinsing and air drying.

TABLE 3

| | Conductive material | | Treatment solution | | | Treatment conditions | | Result | | | |
|---|---|---|---|---|---|---|---|---|---|---|---|
| Exp. No. | Substrate | Electrode material | Treatment solution type | Solution temp. | pH | Potential | Time | Deposition state | Surface condition | Deposition | Note |
| 101 | Conductive rubber | Platinum | 0.1 M titanium chloride + 0.05 M ammonium hydrogen fluoride (Ti:F (molar ratio) = 1:1) | Room temp. | 3 | 50 mV | 5 min | x | x | — | Comp. Ex. |

TABLE 3-continued

| | Conductive material | | Treatment solution | | | Treatment conditions | | Result | | | |
|---|---|---|---|---|---|---|---|---|---|---|---|
| Exp. No. | Substrate | Electrode material | Treatment solution type | Solution temp. | pH | Potential | Time | Deposition state | Surface condition | Deposition | Note |
| 102 | Conductive rubber | Platinum | 0.1 M titanium chloride + 0.1 M ammonium hydrogen fluoride (Ti:F (molar ratio) = 1:2) | Room temp. | 3 | 50 mV | 5 min | x | x | — | Comp. Ex. |
| 103 | Conductive rubber | Platinum | 0.1 M titanium chloride + 0.15 M ammonium hydrogen fluoride (Ti:F (molar ratio) = 1:3) | Room temp. | 3 | 50 mV | 5 min | x | x | — | Comp. Ex. |
| 104 | Conductive rubber | Platinum | 0. 1 M titanium chloride + 0.2 M ammonium hydrogen fluoride (Ti:F (molar ratio) = 1:4) | Room temp. | 3 | 50 mV | 5 min | ○ | ○ | about 1 μg/cm$^2$ | Example |
| 105 | Conductive rubber | Platinum | 0.1 M titanium chloride + 0.25 M ammonium hydrogen fluoride (Ti:F (molar ratio) = 1:5) | Room temp. | 3 | 50 mV | 5 min | ○ | ○ | about 1 μg/cm$^2$ | Example |
| 106 | Conductive rubber | Platinum | 0.1 M titanium chloride + 0.3 M ammonium hydrogen fluoride (Ti:F (molar ratio) = 1:6) | Room temp. | 3 | 50 mV | 5 min | ○ | ○ | about 1 μg/cm$^2$ | Example |
| 107 | Conductive rubber | Platinum | 0.1 M ammonium hexafluorotitanate | Room temp. | 1 | 50 mV | 5 min | x | x | — | Comp. Ex. |
| 108 | Conductive rubber | Platinum | 0.1 M ammonium hexafluorotitanate | Room temp. | 3 | 50 mV | 5 min | ○ | ○ | about 1 μg/cm$^2$ | Example |
| 109 | Conductive rubber | Platinum | 0.1 M ammonium hexafluorotitanate | 50° C. | 3 | 50 mV | 5 min | ○ | ○ | about 25 μg/cm$^2$ | Example |
| 110 | Conductive rubber | Platinum | 0.1 M ammonium hexafluorotitanate | 80° C. | 3 | 50 mV | 5 min | ○ | ○ | about 50 μg/cm$^2$ | Example |
| 111 | Conductive rubber | Platinum | 0.1 M ammonium hexafluorotitanate | Room temp. | 5 | 50 mV | 5 min | ○ | ○ | about 1 μg/cm$^2$ | Example |
| 112 | Conductive rubber | Platinum | 0.1 M ammonium hexafluorotitanate | Room temp. | 7 | 50 mV | 5 min | ○ | ○ | about 1 μg/cm$^2$ | Example |
| 113 | Conductive rubber | Platinum | 0.1 M ammonium hexafluorotitanate | Room temp. | 9 | 50 mV | 5 min | x | x | — | Comp. Ex. |
| 114 | Conductive rubber | Platinum | 0.1 M potassium hexafluorozirconate | Room temp. | 1 | 50 mV | 5 min | x | x | — | Comp. Ex. |
| 115 | Conductive rubber | Platinum | 0.1 M potassium hexafluorozirconate | Room temp. | 3 | 50 mV | 5 min | ○ | ○ | about 1 μg/cm$^2$ | Example |
| 116 | Conductive rubber | Platinum | 0.1 M potassium hexafluorozirconate | Room temp. | 5 | 50 mV | 5 min | ○ | ○ | about 1 μg/cm$^2$ | Example |
| 117 | Conductive rubber | Platinum | 0.1 M potassium hexafluorozirconate | Room temp. | 7 | 50 mV | 5 min | ○ | ○ | about 1 μg/cm$^2$ | Example |
| 118 | Conductive rubber | Platinum | 0.1 M potassium hexafluorozirconate | Room temp. | 9 | 50 mV | 5 min | x | x | — | Comp. Ex. |
| 119 | SUS304 | Platinum | 0.1 M titanium chloride + 0.05 M ammonium hydrogen fluoride (Ti:F (molar ratio) = 1:1) | Room temp. | 3 | 50 mV | 5 min | x | x | — | Comp. Ex. |
| 120 | SUS304 | Platinum | 0.1 M titanium chloride + 0.1 M ammonium hydrogen fluoride (Ti:F (molar ratio) = 1:2) | Room temp. | 3 | 50 mV | 5 min | x | x | — | Comp. Ex. |
| 121 | SUS304 | Platinum | 0.1 M titanium chloride + 0.15 M ammonium hydrogen fluoride (Ti:F (molar ratio) = 1:3) | Room temp. | 3 | 50 mV | 5 min | x | x | — | Comp. Ex. |
| 122 | SUS304 | Platinum | 0.1 M titanium chloride + 0.2 M ammonium hydrogen fluoride (Ti:F (molar ratio) = 1:4) | Room temp. | 3 | 50 mV | 5 min | ○ | ○ | about 1 μg/cm$^2$ | Example |
| 123 | SUS304 | Platinum | 0.1 M titanium chloride + 0.25 M ammonium hydrogen fluoride (Ti:F (molar ratio) = 1:5) | Room temp. | 3 | 50 mV | 5 min | ○ | ○ | about 1 μg/cm$^2$ | Example |
| 124 | SUS304 | Platinum | 0.1 M titanium chloride + 0.3 M ammonium hydrogen fluoride (Ti:F (molar ratio) = 1:6) | Room temp. | 3 | 50 mV | 5 min | ○ | ○ | about 1 μg/cm$^2$ | Example |
| 125 | SUS304 | Platinum | 0.1 M ammonium hexafluorotitanate | Room temp. | 1 | 50 mV | 5 min | x | x | — | Comp. Ex. |
| 126 | SUS304 | Platinum | 0.1 M ammonium hexafluorotitanate | Room temp. | 3 | 50 mV | 5 min | ○ | ◎ | about 1 μg/cm$^2$ | Example |
| 127 | SUS304 | Platinum | 0.1 M ammonium hexafluorotitanate | Room temp. | 5 | 50 mV | 5 min | ○ | ○ | about 1 μg/cm$^2$ | Example |
| 128 | SUS304 | Platinum | 0.1 M ammonium hexafluorotitanate | Room temp. | 7 | 50 mV | 5 min | ○ | ○ | about 1 μg/cm$^2$ | Example |
| 129 | SUS304 | Platinum | 0.1 M ammonium hexafluorotitanate | Room temp. | 9 | 50 mV | 5 min | x | x | — | Comp. Ex. |
| 130 | SUS304 | Platinum | 0.1 M ammonium hexafluorosilicate | Room temp. | 1 | 50 mV | 5 min | x | x | — | Comp. Ex. |
| 131 | SUS304 | Platinum | 0.1 M ammonium hexafluorosilicate | Room temp. | 3 | 50 mV | 5 min | ○ | ◎ | about 1 μg/cm$^2$ | Example |
| 132 | SUS304 | Platinum | 0.1 M ammonium hexafluorosilicate | Room temp. | 5 | 50 mV | 5 min | ○ | ○ | about 1 μg/cm$^2$ | Example |

TABLE 3-continued

| | Conductive material | | Treatment solution | | | Treatment conditions | | Result | | | |
|---|---|---|---|---|---|---|---|---|---|---|---|
| Exp. No. | Substrate | Electrode material | Treatment solution type | Solution temp. | pH | Potential | Time | Deposition state | Surface condition | Deposition | Note |
| 133 | SUS304 | Platinum | 0.1 M ammonium hexafluorosilicate | Room temp. | 7 | 50 mV | 5 min | ○ | ○ | about 1 μg/cm$^2$ | Example |
| 134 | SUS304 | Platinum | 0.1 M ammonium hexafluorosilicate | Room temp. | 9 | 50 mV | 5 min | x | x | — | Comp. Ex. |

TABLE 4

| | Conductive material | | Treatment solution | | | | Treatment conditions | | Result | | | | |
|---|---|---|---|---|---|---|---|---|---|---|---|---|---|
| Exp. No. | Substrate | Electrode material | Treatment solution type | Solution temp. | pH | Additive | Potential | Time | Deposition state | Surface condition | Deposition | Deposition structure | Note |
| 135 | Iron | Platinum | Layer 1: 0.1 M ammonium hexafluorotitanate | Room temp. | 3 | none | 50 mV | 2.5 min | ○ | ○ | about 1 μg/cm$^2$ | Bilayer structure | Ex. |
| | | | Layer 2: 0.1 M ammonium hexafluorosilicate | Room temp. | 3 | none | 50 mV | 2.5 min | | | | | |
| 136 | Iron | Platinum | Layer 1: 0.1 M ammonium hexafluorotitanate | Room temp. | 3 | none | 50 mV | 1 min | ○ | ○ | about 1 μg/cm$^2$ | Laminated structure | Ex. |
| | | | Layer 2: 0.08 M ammonium hexafluorotitanate + 0.02 M ammonium hexafluorosilicate | Room temp. | 3 | none | 50 mV | 1 min | | | | | |
| | | | Layer 3: 0.06 M ammonium hexafluorotitanate + 0.04 M ammonium hexafluorosilicate | Room temp. | 3 | none | 50 mV | 1 min | | | | | |
| | | | Layer 4: 0.04 M ammonium hexafluorotitanate + 0.06 M ammonium hexafluorosilicate | Room temp. | 3 | none | 50 mV | 1 min | | | | | |
| | | | Layer 5: 0.02 M ammonium hexafluorotitanate + 0.08 M ammonium hexafluorosilicate | Room temp. | 3 | none | 50 mV | 1 min | | | | | |
| 137 | Iron | Platinum | 0.1 M ammonium hexafluorotitanate | Room temp. | 3 | 1% zinc chloride | 50 mV | 5 min | ○ | ○ | about 1 μg/cm$^2$ | Fine dispersed structure | Ex. |
| 138 | Iron | Platinum | 0.1 M ammonium hexafluorotitanate | Room temp. | 3 | 1% gold chloride | 50 mV | 5 min | ○ | ○ | about 1 μg/cm$^2$ | Fine dispersed structure | Ex. |
| 139 | Iron | Platinum | 0.1 M ammonium hexafluorotitanate | Room temp. | 3 | 1% palladium chloride | 50 mV | 5 min | ○ | ○ | about 1 μg/cm$^2$ | Fine dispersed structure | Ex. |
| 140 | Glass | — | 0.1 M ammonium hexafluorotitanate | Room temp. | 3 | none | — | 5 hrs | — | ○ | about 1 μg/cm$^2$ | | Comp. Ex. |
| 141 | Iron | Platinum | 0.1 M ammonium hexafluorotitanate | Room temp. | 3 | EDTA-cerium | 50 mV | 5 min | ○ | ○ | about 1 μg/cm$^2$ | Fine dispersed structure | Ex. |

Example 3

[Experiment Nos. 201-228]

Films were formed by immersion of various plated steel sheets as the base materials in aqueous solutions of ammonium hexafluorosilicate, ammonium hexafluorotitanate and ammonium hexafluorozirconate. The film formation was carried out for 5 minutes at room temperature, and the film formation was followed by water rinsing and air drying (see Table 5).

[Experiment Nos. 301-321]

Films were formed on various plated steel sheets as the base materials in aqueous solutions of ammonium hexafluorosilicate, ammonium hexafluorotitanate and ammonium hexafluorozirconate, by cathode electrolysis using platinum as the counter electrode. The film formation was carried out for 5 minutes at room temperature, and the film formation was followed by water rinsing and air drying (see Table 6).

[Experiment Nos. 401-421]

Films were formed on various plated steel sheets as the base materials in aqueous solutions of ammonium hexafluorosilicate, ammonium hexafluorotitanate and ammonium hexafluorozirconate, by cathode electrolysis using aluminum as the counter electrode. The film formation was carried out for 5 minutes at room temperature, and the film formation was followed by water rinsing and air drying (see Table 7).

The primary coating adhesion was determined using a bar coater to coat a melamine alkyd resin paint (Amylaq #1000, product of Kansai Paint Co., Ltd.).to a dry film thickness of 30 μm, and then baking at a furnace temperature of 130° C. for 20 minutes. After allowing it to stand overnight, it was then subjected to 7 mm Erichsen working. Adhesive tape (Cellotape, trade name of Nichiban Co., Ltd.) was pasted to the worked section and peeled off by rapidly pulling at a 45° angle, and the following evaluation was made based on the peel area.

○: Peel area of less than 5%

Δ: Peel area of 25% and <50% x: Peel area of 50% or greater

The secondary coating and was determined in the same manner as the primary coating adhesion, with coating of a melamine alkyd paint, standing overnight and then immersion in boiling water for 30 minutes. After 7 mm Erichsen working, adhesive tape (Cellotape, trade name of Nichiban Co., Ltd.) was pasted to the worked section and peeled off by rapidly pulling at a 45° angle, and the following evaluation was made based on the peel area.

○: Peel area of less than 10%

Δ: Peel area of ≧10% and <60% x: Peel area of 60% or greater

The plate corrosion resistance was determined according to the salt water spray test method described in JIS Z 2371, blowing a 5% NaCl solution onto the test sheet at an atmosphere temperature of 35° C., and evaluating the white rust generation after 240 hours based on the following.

○: White rust generation of less than 10%

Δ: White rust generation of ≧10% and <30% x: White rust generation of 30% or greater

The working section corrosion resistance was determined by 7 mm Erichsen working, followed by a test according to the salt water spray test method described in JIS Z 2371, blowing a 5% NaCl solution onto the test sheet at an atmosphere temperature of 35° C., and evaluating the white rust generation on the worked section after 72 hours based on the following.

○: White rust generation of less than 10%

Δ: White rust generation of ≧10% and <30% x: White rust generation of 30% or greater

TABLE 5

| | Electrode material | Treatment solution | | | | Corrosion resistance | | Paint adhesion | | |
|---|---|---|---|---|---|---|---|---|---|---|
| Exp. No. | Substrate | Treatment solution type | Solution temp. | pH | Time (min) | Sheet | Worked section | Primary | Second-ary | |
| 201 | Zinc electroplated steel | 0.1 M ammonium hexafluorosilicate | Room temp. | 3 | 10 | ○ | ○ | ○ | ○ | Ex. |
| 202 | Zinc electroplated steel | 0.1 M ammonium hexafluorotitanate | Room temp. | 3 | 10 | ○ | ○ | ○ | ○ | Ex. |
| 203 | Zinc electroplated steel | 0.1 M ammonium hexafluorozirconate | Room temp. | 3 | 10 | ○ | ○ | ○ | ○ | Ex. |
| 204 | Zinc electroplated steel | no treatment | | | | x | x | x | x | Comp. |
| 205 | Zinc hot-dip plated steel sheet | 0.1 M ammonium hexafluorosilicate | Room temp. | 3 | 10 | ○ | ○ | ○ | ○ | Ex. |
| 206 | Zinc hot-dip plated steel sheet | 0.1 M ammonium hexafluorotitanate | Room temp. | 3 | 10 | ○ | ○ | ○ | ○ | Ex. |
| 207 | Zinc hot-dip plated steel sheet | 0.1 M ammonium hexafluorozirconate | Room temp. | 3 | 10 | ○ | ○ | ○ | ○ | Ex. |
| 208 | Zinc hot-dip plated steel sheet | no treatment | | | | x | x | x | x | Comp. |
| 209 | Aluminum hot-dip plated steel sheet | 0.1 M ammonium hexafluorosilicate | Room temp. | 3 | 10 | ○ | ○ | ○ | ○ | Ex. |
| 210 | Aluminum hot-dip plated steel sheet | 0.1 M ammonium hexafluorotitanate | Room temp. | 3 | 10 | ○ | ○ | ○ | ○ | Ex. |
| 211 | Aluminum hot-dip plated steel sheet | 0.1 M ammonium hexafluorozirconate | Room temp. | 3 | 10 | ○ | ○ | ○ | ○ | Ex. |
| 212 | Aluminum hot-dip plated steel sheet | no treatment | | | | x | x | x | x | Comp. |
| 213 | Zinc hot-dip plated steel sheet | 0.1 M ammonium hexafluorosilicate | Room temp. | 3 | 10 | ○ | ○ | ○ | ○ | Ex. |
| 214 | Zinc hot-dip plated steel sheet | 0.1 M ammonium hexafluorotitanate | Room temp. | 3 | 10 | ○ | ○ | ○ | ○ | Ex. |
| 215 | Zinc hot-dip plated steel sheet | 0.1 M ammonium hexafluorozirconate | Room temp. | 3 | 10 | ○ | ○ | ○ | ○ | Ex. |
| 216 | Zinc hot-dip plated steel sheet | no treatment | | | | x | x | x | x | Comp. |
| 217 | Zinc-aluminum hot-dip plated steel sheet | 0.1 M ammonium hexafluorosilicate | Room temp. | 3 | 10 | ○ | ○ | ○ | ○ | Ex. |
| 218 | Zinc-aluminum hot-dip plated steel sheet | 0.1 M ammonium hexafluorotitanate | Room temp. | 3 | 10 | ○ | ○ | ○ | ○ | Ex. |
| 219 | Zinc-aluminum hot-dip plated steel sheet | 0.1 M ammonium hexafluorozirconate | Room temp. | 3 | 10 | ○ | ○ | ○ | ○ | Ex. |
| 220 | Zinc-aluminum hot-dip plated steel sheet | no treatment | | | | x | x | x | x | Comp. |

TABLE 5-continued

| Exp. No. | Electrode material: Substrate | Treatment solution: Treatment solution type | Solution temp. | pH | Time (min) | Corrosion resistance: Sheet | Corrosion resistance: Worked section | Paint adhesion: Primary | Paint adhesion: Secondary | |
|---|---|---|---|---|---|---|---|---|---|---|
| 221 | Tin-plated steel sheet | 0.1 M ammonium hexafluorosilicate | Room temp. | 3 | 10 | ○ | ○ | ○ | ○ | Ex. |
| 222 | Tin-plated steel sheet | 0.1 M ammonium hexafluorotitanate | Room temp. | 3 | 10 | ○ | ○ | ○ | ○ | Ex. |
| 223 | Tin-plated steel sheet | 0.1 M ammonium hexafluorozirconate | Room temp. | 3 | 10 | ○ | ○ | ○ | ○ | Ex. |
| 224 | Tin-plated steel sheet | no treatment | | | | Δ | Δ | Δ | Δ | Comp. |
| 225 | Chromium-plated steel sheet | 0.1 M ammonium hexafluorosilicate | Room temp. | 3 | 10 | ○ | ○ | ○ | ○ | Ex. |
| 226 | Chromium-plated steel sheet | 0.1 M ammonium hexafluorotitanate | Room temp. | 3 | 10 | ○ | ○ | ○ | ○ | Ex. |
| 227 | Chromium-plated steel sheet | 0.1 M ammonium hexafluorozirconate | Room temp. | 3 | 10 | ○ | ○ | ○ | ○ | Ex. |
| 228 | Chromium-plated steel sheet | no treatment | | | | Δ | Δ | Δ | Δ | Comp. |

TABLE 6

| Exp. No. | Electrode material: Substrate | Electrode material: Insoluble material | Treatment solution: Treatment solution type | Treatment solution: Solution temp. | Treatment solution: pH | Treatment conditions: Current | Treatment conditions: Time (min) | Corrosion resistance: Sheet | Corrosion resistance: Worked section | Paint adhesion: Primary | Paint adhesion: Secondary | |
|---|---|---|---|---|---|---|---|---|---|---|---|---|
| 301 | Zinc electroplated steel | Platinum | 0.1 M ammonium hexafluorosilicate | Room temp. | 3 | 100 mA/cm$^2$ | 5 | ○ | ○ | ○ | ○ | Ex. |
| 302 | Zinc electroplated steel | Platinum | 0.1 M ammonium hexafluorotitanate | Room temp. | 3 | 100 mA/cm$^2$ | 5 | ○ | ○ | ○ | ○ | Ex. |
| 303 | Zinc electroplated steel | Platinum | 0.1 M ammonium hexafluorozirconate | Room temp. | 3 | 100 mA/cm$^2$ | 5 | ○ | ○ | ○ | ○ | Ex. |
| 304 | Zinc hot-dip plated steel sheet | Platinum | 0.1 M ammonium hexafluorosilicate | Room temp. | 3 | 100 mA/cm$^2$ | 5 | ○ | ○ | ○ | ○ | Ex. |
| 305 | Zinc hot-dip plated steel sheet | Platinum | 0.1 M ammonium hexafluorotitanate | Room temp. | 3 | 100 mA/cm$^2$ | 5 | ○ | ○ | ○ | ○ | Ex. |
| 306 | Zinc hot-dip plated steel sheet | Platinum | 0.1 M ammonium hexafluorozirconate | Room temp. | 3 | 100 mA/cm$^2$ | 5 | ○ | ○ | ○ | ○ | Ex. |
| 307 | Aluminum hot-dip plated steel sheet | Platinum | 0.1 M ammonium hexafluorosilicate | Room temp. | 3 | 100 mA/cm$^2$ | 5 | ○ | ○ | ○ | ○ | Ex. |
| 308 | Aluminum hot-dip plated steel sheet | Platinum | 0.1 M ammonium hexafluorotitanate | Room temp. | 3 | 100 mA/cm$^2$ | 5 | ○ | ○ | ○ | ○ | Ex. |
| 309 | Aluminum hot-dip plated steel sheet | Platinum | 0.1 M ammonium hexafluorozirconate | Room temp. | 3 | 100 mA/cm$^2$ | 5 | ○ | ○ | ○ | ○ | Ex. |
| 310 | Zinc hot-dip plated steel sheet | Platinum | 0.1 M ammonium hexafluorosilicate | Room temp. | 3 | 100 mA/cm$^2$ | 5 | ○ | ○ | ○ | ○ | Ex. |
| 311 | Zinc hot-dip plated steel sheet | Platinum | 0.1 M ammonium hexafluorotitanate | Room temp. | 3 | 100 mA/cm$^2$ | 5 | ○ | ○ | ○ | ○ | Ex. |
| 312 | Zinc hot-dip plated steel sheet | Platinum | 0.1 M ammonium hexafluorozirconate | Room temp. | 3 | 100 mA/cm$^2$ | 5 | ○ | ○ | ○ | ○ | Ex. |
| 313 | Zinc-aluminum hot-dip plated steel sheet | Platinum | 0.1 M ammonium hexafluorosilicate | Room temp. | 3 | 100 mA/cm$^2$ | 5 | ○ | ○ | ○ | ○ | Ex. |
| 314 | Zinc-aluminum hot-dip plated steel sheet | Platinum | 0 1 M ammonium hexafluorotitanate | Room temp. | 3 | 100 mA/cm$^2$ | 5 | ○ | ○ | ○ | ○ | Ex. |
| 315 | Zinc-aluminum hot-dip plated steel sheet | Platinum | 0.1 M ammonium hexafluorozirconate | Room temp. | 3 | 100 mA/cm$^2$ | 5 | ○ | ○ | ○ | ○ | Ex. |
| 316 | Tin-plated steel sheet | Platinum | 0.1 M ammonium hexafluorosilicate | Room temp. | 3 | 100 mA/cm$^2$ | 5 | ○ | ○ | ○ | ○ | Ex. |
| 317 | Tin-plated steel sheet | Platinum | 0.1 M ammonium hexafluorotitanate | Room temp. | 3 | 100 mA/cm$^2$ | 5 | ○ | ○ | ○ | ○ | Ex. |
| 318 | Tin-plated steel sheet | Platinum | 0 1 M ammonium hexafluorozirconate | Room temp. | 3 | 100 mA/cm$^2$ | 5 | ○ | ○ | ○ | ○ | Ex. |
| 319 | Chromium-plated steel sheet | Platinum | 0.1 M ammonium hexafluorosilicate | Room temp. | 3 | 100 mA/cm$^2$ | 5 | ○ | ○ | ○ | ○ | Ex. |
| 320 | Chromium-plated steel sheet | Platinum | 0.1 M ammonium hexafluorotitanate | Room temp. | 3 | 100 mA/cm$^2$ | 5 | ○ | ○ | ○ | ○ | Ex. |
| 321 | Chromium-plated steel sheet | Platinum | 0.1 M ammonium hexafluorozirconate | Room temp. | 3 | 100 mA/cm$^2$ | 5 | ○ | ○ | ○ | ○ | Ex. |

TABLE 7

| Exp. No. | Electrode material: Substrate | Electrode | Treatment solution: Treatment solution type | Solution temp. | pH | Treatment conditions: Current | Time (min) | Corrosion resistance: Sheet | Worked section | Paint adhesion: Primary | Secondary | |
|---|---|---|---|---|---|---|---|---|---|---|---|---|
| 401 | Zinc electroplated steel | Aluminum | 0.1 M ammonium hexafluorosilicate | Room temp. | 3 | 100 mA/cm$^2$ | 5 | ○ | ○ | ○ | ○ | Ex. |
| 402 | Zinc electroplated steel | Aluminum | 0.1 M ammonium hexafluorotitanate | Room temp. | 3 | 100 mA/cm$^2$ | 5 | ○ | ○ | ○ | ○ | Ex. |
| 403 | Zinc electroplated steel | Aluminum | 0.1 M ammonium hexafluorozirconate | Room temp. | 3 | 100 mA/cm$^2$ | 5 | ○ | ○ | ○ | ○ | Ex. |
| 404 | Zinc hot-dip plated steel sheet | Aluminum | 0.1 M ammonium hexafluorosilicate | Room temp. | 3 | 100 mA/cm$^2$ | 5 | ○ | ○ | ○ | ○ | Ex. |
| 405 | Zinc hot-dip plated steel sheet | Aluminum | 0.1 M ammonium hexafluorotitanate | Room temp. | 3 | 100 mA/cm$^2$ | 5 | ○ | ○ | ○ | ○ | Ex. |
| 406 | Zinc hot-dip plated steel sheet | Aluminum | 0.1 M ammonium hexafluorozirconate | Room temp. | 3 | 100 mA/cm$^2$ | 5 | ○ | ○ | ○ | ○ | Ex. |
| 407 | Aluminum hot-dip plated steel sheet | Aluminum | 0.1 M ammonium hexafluorosilicate | Room temp. | 3 | 100 mA/cm$^2$ | 5 | ○ | ○ | ○ | ○ | Ex. |
| 408 | Aluminum hot-dip plated steel sheet | Aluminum | 0.1 M ammonium hexafluorotitanate | Room temp. | 3 | 100 mA/cm$^2$ | 5 | ○ | ○ | ○ | ○ | Ex. |
| 409 | Aluminum hot-dip plated steel sheet | Aluminum | 0.1 M ammonium hexafluorozirconate | Room temp. | 3 | 100 mA/cm$^2$ | 5 | ○ | ○ | ○ | ○ | Ex. |
| 410 | Zinc hot-dip plated steel sheet | Aluminum | 0.1 M ammonium hexafluorosilicate | Room temp. | 3 | 100 mA/cm$^2$ | 5 | ○ | ○ | ○ | ○ | Ex. |
| 411 | Zinc hot-dip plated steel sheet | Aluminum | 0.1 M ammonium hexafluorotitanate | Room temp. | 3 | 100 mA/cm$^2$ | 5 | ○ | ○ | ○ | ○ | Ex. |
| 412 | Zinc hot-dip plated steel sheet | Aluminum | 0.1 M ammonium hexafluorozirconate | Room temp. | 3 | 100 mA/cm$^2$ | 5 | ○ | ○ | ○ | ○ | Ex. |
| 413 | Zinc-aluminum hot-dip plated steel sheet | Aluminum | 0.1 M ammonium hexafluorosilicate | Room temp. | 3 | 100 mA/cm$^2$ | 5 | ○ | ○ | ○ | ○ | Ex |
| 414 | Zinc-aluminum hot-dip plated steel sheet | Aluminum | 0.1 M ammonium hexafluorotitanate | Room temp. | 3 | 100 mA/cm$^2$ | 5 | ○ | ○ | ○ | ○ | Ex. |
| 415 | Zinc-aluminum hot-dip plated steel sheet | Aluminum | 0.1 M ammonium hexafluorozirconate | Room temp. | 3 | 100 mA/cm$^2$ | 5 | ○ | ○ | ○ | ○ | Ex. |
| 416 | Tin-plated steel sheet | Aluminum | 0.1 M ammonium hexafluorosilicate | Room temp. | 3 | 100 mA/cm$^2$ | 5 | ○ | ○ | ○ | ○ | Ex. |
| 417 | Tin-plated steel sheet | Aluminum | 0.1 M ammonium hexafluorotitanate | Room temp. | 3 | 100 mA/cm$^2$ | 5 | ○ | ○ | ○ | ○ | Ex. |
| 418 | Tin-plated steel sheet | Aluminum | 0.1 M ammonium hexafluorozirconate | Room temp. | 3 | 100 mA/cm$^2$ | 5 | ○ | ○ | ○ | ○ | Ex. |
| 419 | Chromium-plated steel sheet | Aluminum | 0.1 M ammonium hexafluorosilicate | Room temp. | 3 | 100 mA/cm$^2$ | 5 | ○ | ○ | ○ | ○ | Ex. |
| 420 | Chromium-plated steel sheet | Aluminum | 0.1 M ammonium hexafluorotitanate | Room temp. | 3 | 100 mA/cm$^2$ | 5 | ○ | ○ | ○ | ○ | Ex. |
| 421 | Chromium-plated steel sheet | Aluminum | 0.1 M ammonium hexafluorozirconate | Room temp. | 3 | 100 mA/cm$^2$ | 5 | ○ | ○ | ○ | ○ | Ex. |

Example 4

[Experiment Nos. 501-520]

Films were formed by immersion of stainless steel sheets and pure iron as the base materials in aqueous solutions of ammonium hexafluorosilicate, ammonium hexafluorotitanate and ammonium hexafluorozirconate, using the electrolysis apparatuses shown in FIGS. 1 to 4 (see Table 8).

The deposition states were evaluated by the same methods as for Examples 1 and 2.

TABLE 8

| Exp. No. | Substrate: Type | Sheet thickness | Counter electrode Type | Treated side | Electrolytic solution: Type | pH | Temp. | Circulation | Current | Transport speed | Result: Deposition state | Surface condition | Device used | Note |
|---|---|---|---|---|---|---|---|---|---|---|---|---|---|---|
| 501 | Stainless steel sheet | 10 μm | Aluminum | one | 0.1 M aqueous ammonium hexafluorotitanate | 3 | 50° C. | + | 10 A/dm$^2$ | 1 mpm | ○ | ○ | FIG. 1 | Ex. |
| 502 | Stainless steel sheet | 10 μm | Aluminum | both | 0.1 M aqueous ammonium hexafluorotitanate | 3 | 50° C. | + | 10 A/dm$^2$ | 1 mpm | ○ | ○ | FIG. 2 | Ex. |

TABLE 8-continued

| | Substrate | | | | Electrolytic solution | | | | | | Result | | | |
|---|---|---|---|---|---|---|---|---|---|---|---|---|---|---|
| Exp. No. | Type | Sheet thickness | Counter electrode Type | Treated side | Type | pH | Temp. | Circulation | Current | Transport speed | Deposition state | Surface condition | Device used | Note |
| 503 | Stainless steel sheet | 10 μm | Aluminum | one | 0.1 M aqueous ammonium hexafluorotitanate | 3 | 50° C. | − | 1 A/dm$^2$ | 1 mpm | ○ | ○ | FIG. 1 | Ex. |
| 504 | Stainless steel sheet | 10 μm | Aluminum | both | 0.1 M aqueous ammonium hexafluorotitanate | 3 | 50° C. | − | 1 A/dm$^2$ | 1 mpm | ○ | ○ | FIG. 2 | Ex. |
| 505 | Stainless steel sheet | 10 μm | Aluminum | one | 0.1 M aqueous ammonium hexafluorotitanate | 3 | 50° C. | + | base and electrode shorted | 1 mpm | ○ | ○ | electrode in FIG. 1 shorted | Ex. |
| 506 | Stainless steel sheet | 10 μm | Aluminum | both | 0.1 M aqueous ammonium hexafluorotitanate | 3 | 50° C. | + | base and electrode shorted | 1 mpm | ○ | ○ | electrode in FIG. 2 shorted | Ex. |
| 507 | Stainless steel sheet | 10 μm | Aluminum | one | 0.1 M aqueous ammonium hexafluorotitanate | 3 | 50° C. | + | 10 A/dm$^2$ | 1 mpm | ○ | ○ | FIG. 3 | Ex. |
| 508 | Stainless steel sheet | 10 μm | Aluminum | both | 0.1 M aqueous ammonium hexafluorotitanate | 3 | 50° C. | + | 10 A/dm$^2$ | 1 mpm | ○ | ○ | FIG. 4 | Ex. |
| 509 | Stainless steel sheet | 100 μm | Aluminum | one | 0.1 M aqueous ammonium hexafluorosilicate | 3 | 50° C. | + | 10 A/dm$^2$ | 1 mpm | ○ | ○ | FIG. 1 | Ex. |
| 510 | Stainless steel sheet | 100 μm | Aluminum | both | 0.1 M aqueous ammonium hexafluorosilicate | 3 | 50° C. | + | 10 A/dm$^2$ | 1 mpm | ○ | ○ | FIG. 2 | Ex. |
| 511 | Stainless steel sheet | 100 μm | Aluminum | one | 0.1 M aqueous ammonium hexafluorosilicate | 3 | 50° C. | + | base and electrode shorted | 1 mpm | ○ | ○ | electrode in FIG. 1 shorted | Ex. |
| 512 | Stainless steel sheet | 100 μm | Aluminum | both | 0.1 M aqueous ammonium hexafluorosilicate | 3 | 50° C. | + | base and electrode shorted | 1 mpm | ○ | ○ | electrode in FIG. 2 shorted | Ex. |
| 513 | Stainless steel sheet | 100 μm | Aluminum | one | 0.1 M aqueous ammonium hexafluorosilicate | 3 | 50° C. | + | 10 A/dm$^2$ | 1 mpm | ○ | ○ | FIG. 3 | Ex. |
| 514 | Stainless steel sheet | 100 μm | Aluminum | both | 0.1 M aqueous ammonium hexafluorosilicate | 3 | 50° C. | + | 10 A/dm$^2$ | 1 mpm | ○ | ○ | FIG. 4 | Ex. |
| 515 | Iron | 200 μm | Aluminum | one | 0.1 M aqueous ammonium hexafluorozirconate | 3 | 50° C. | + | 10 A/dm$^2$ | 10 mpm | ○ | ○ | FIG. 1 | Ex. |
| 516 | Iron | 200 μm | Aluminum | both | 0.1 M aqueous ammonium hexafluorozirconate | 3 | 50° C. | + | 10 A/dm$^2$ | 10 mpm | ○ | ○ | FIG. 2 | Ex. |
| 517 | Iron | 200 μm | Aluminum | one | 0.1 M aqueous ammonium hexafluorozirconate | 3 | 50° C. | + | base and electrode shorted | 10 mpm | ○ | ○ | electrode in FIG. 1 shorted | Ex. |
| 518 | Iron | 200 μm | Aluminum | both | 0.1 M aqueous ammonium hexafluorozirconate | 3 | 50° C. | + | base and electrode shorted | 10 mpm | ○ | ○ | electrode in FIG. 2 shorted | Ex. |
| 519 | Iron | 200 μm | Aluminum | one | 0.1 M aqueous ammonium hexafluorozirconate | 3 | 50° C. | + | 10 A/dm$^2$ | 10 mpm | ○ | ○ | FIG. 3 | Ex. |
| 520 | Iron | 200 μm | Aluminum | both | 0.1 M aqueous ammonium hexafluorozirconate | 3 | 50° C. | + | 10 A/dm$^2$ | 10 mpm | ○ | ○ | FIG. 4 | Ex. |

INDUSTRIAL APPLICABILITY

As explained above, the method of producing a metal oxide and/or metal hydroxide coating on metal materials from aqueous solutions according to the invention allows rapid fabrication of various oxide or hydroxide coatings with various functions and constructions, including corrosion resistance and insulating properties, with the use of simple equipment, and the metal materials having such oxide or hydroxide coatings are suitable for a variety of purposes and are therefore of great industrial significance.

The invention claimed is:

1. A method for production of a metal oxide and/or metal hydroxide coated conductive material, comprising cathode electrolyzing a conductive material in an aqueous treatment solution at pH 2-7 using said conductive material as a cathode, said aqueous treatment solution containing a complex ion, said complex ion comprising at least a metal and fluorine in a 4-fold or more molar ratio with respect to said metal, to form a coating on the surface of said conductive material, consisting of a metal oxide and/or metal hydroxide of said metal.

2. The method for production of a metal oxide and/or metal hydroxide coated conductive material according to claim 1, wherein a plurality of aqueous treatment solutions containing different metals are used to form a coating composed of a plurality of metal oxides and/or metal hydroxides.

3. The method for production of a metal oxide and/or metal hydroxide coated conductive material according to claim 2, wherein a plurality of aqueous treatment solutions with different concentrations of a plurality of metals are used to form a graded concentration coating.

4. The method for production of a metal oxide and/or metal hydroxide coated conductive material according to claim 1, wherein said aqueous treatment solution contains a plurality of metals.

5. The method for production of a metal oxide and/or metal hydroxide coated conductive material according to claim 1, wherein said aqueous treatment solution further contains a metal ion that does not form or is modified not to form a complex with fluorine.

6. The method for production of a metal oxide and/or metal hydroxide coated conductive material according to claim 1, wherein the pH of said aqueous treatment solution is 3-4.

7. The method for production of a metal oxide and/or metal hydroxide coating on a conductive material according to claim 1, wherein the method of electrolysis of said conductive material comprises filling an aqueous treatment solution between the conductive surface of said conductive material and an electrode set opposite thereto, contacting conductor rolls with the conductive surface of the conductive material, and applying a voltage with said conductor roll side as the negative electrode and said electrode side as the positive electrode.

8. The method for continuous production of a metal oxide and/or metal hydroxide coating on a conductive material according to claim 1, wherein the cathode electrolyzing of said conductive material comprises:

providing a first electrode opposing a first portion of said conductive material;

providing a second electrode parallel to said first electrode, said second electrode opposing a second portion of said conductive material;

providing an aqueous treatment solution between said conductive material and said first electrode and said second electrode;

applying a voltage to said first and second electrodes, with one of said first and second electrodes being a positive electrode and the other of said first and second electrodes being a negative electrode or a cathode electrode;

wherein said conductive material is a conductive material sheet continuously moving along said first and second electrodes in a direction parallel to said first and second said electrodes, by which a cathode electrolysis of said conductive material takes place to form the metal oxide and/or metal hydroxide coating on said conductive material.

9. A method for production of a metal oxide and/or metal hydroxide coated metal material, comprising immersing a metal material in an aqueous treatment solution at pH 2-7, said aqueous treatment solution containing a complex ion, said complex ion comprising at least a metal and fluorine in a 4-fold or more molar ratio with respect to said metal, and further immersing a shorting metal in said aqueous treatment solution, said shorting metal having a lower electrode potential than said metal material immersed in said aqueous treatment solution, to form on the surface of said metal material a coating by cathode electrolysis using said metal material as a cathode, said coating consisting of metal oxide and/or metal hydroxide of said metal of said complex ion.

10. The method for production of a metal oxide and/or metal hydroxide coated metal material according to claim 9, wherein a plurality of aqueous treatment solutions with different concentrations of a plurality of metals are used to form a graded concentration coating.

11. The method for production of a metal oxide and/or metal hydroxide coated metal material according to claim 9, wherein said metal material is a stainless steel sheet with a thickness of 10 μm or greater.

12. The method for production of a metal oxide and/or metal hydroxide coated metal material according to claim 9, wherein said metal material is a steel sheet or plated steel sheet.

13. The method for production of a metal oxide and/or metal hydroxide coated metal material according to claim 12, wherein said metal material is a plated steel sheet with a plating layer composed mainly of zinc and/or aluminum.

14. A method for production of a metal oxide and/or metal hydroxide coated metal material, comprising immersing a metal material in a plurality of aqueous treatment solutions with different concentrations of a plurality of different metal ions at pH 2-7, each solution containing a complex ion, said complex ion comprising at least a metal and fluorine in a 4-fold or more molar ratio with respect to said metal, each solution forming on the surface of said metal material a coating consisting of a metal oxide and/or metal hydroxide of said metal originating in said complex ion, by cathode electrolysis using said metal material as a cathode, wherein the plurality of aqueous treatment solutions with different concentrations of a plurality of metals form a graded concentration coating on said metal material.

15. The method for production of a metal oxide and/or metal hydroxide coated metal material according to claim 14, further comprising immersing in said aqueous treatment solution a shorting metal having a lower electrode potential than said metal material immersed in said aqueous treatment solution.

16. The method for production of a metal oxide and/or metal hydroxide coated metal material according to claim 14, wherein said metal material is a stainless steel sheet with a thickness of 10 μm or greater.

17. The method for production of a metal oxide and/or metal hydroxide coated metal material according to claim 14, wherein said metal material is a steel sheet or plated steel sheet.

18. The method for production of a metal oxide and/or metal hydroxide coated metal material according to claim 17, wherein said metal material is a plated steel sheet with a platting layer composed mainly of zinc and/or aluminum.

19. A method for production of a metal oxide and/or metal hydroxide coated metal material, comprising immersing a metal material in an aqueous treatment solution at pH 2-7, containing a complex ion, said complex ion comprising at least a metal and fluorine in a 4-fold or more molar ratio with respect to said metal, to form on the surface of said metal material a coating, by cathode electrolysis using said metal material as a cathode, said coating consisting of a metal oxide and/or metal hydroxide, wherein said metal of said metal oxide and/or metal hydroxide originates in said complex ion, and said coated metal material is a stainless steel sheet with a thickness of 10 μm or greater.

20. A method for production of a metal oxide and/or metal hydroxide coated metal material, comprising immersing a metal material in an aqueous treatment solution at pH 2-7, containing a complex ion, said complex ion comprising at least a metal and fluorine in a 4-fold or more molar ratio with respect to said metal, to form on the surface of said metal material a coating, by cathode electrolysis using said metal material as a cathode, said coating consisting of a metal oxide and/or metal hydroxide, wherein said metal of said metal oxide and/or metal hydroxide originates in said complex ion, and said metal material is a steel sheet or plated steel sheet.

21. The method for production of a metal oxide and/or metal hydroxide coated metal material according to claim 20, wherein said plated steel sheet is a plated steel sheet with a plating layer composed mainly of zinc and/or aluminum.

* * * * *